US008919445B2

(12) United States Patent
Fowler

(10) Patent No.: US 8,919,445 B2
(45) Date of Patent: Dec. 30, 2014

(54) METHOD AND SYSTEM FOR FLOW ASSURANCE MANAGEMENT IN SUBSEA SINGLE PRODUCTION FLOWLINE

(75) Inventor: Tracy A. Fowler, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 468 days.

(21) Appl. No.: 13/273,790

(22) Filed: Oct. 14, 2011

(65) Prior Publication Data

US 2012/0031621 A1 Feb. 9, 2012

Related U.S. Application Data

(63) Continuation of application No. 12/676,542, filed as application No. PCT/US2008/073354 on Aug. 15, 2008, now Pat. No. 8,469,101.

(60) Provisional application No. 60/995,161, filed on Sep. 25, 2007.

(51) Int. Cl.

| | |
|---|---|
| ***E21B 43/01*** | (2006.01) |
| ***E21B 47/017*** | (2012.01) |
| ***E21B 43/20*** | (2006.01) |
| ***E21B 37/00*** | (2006.01) |
| ***E21B 36/00*** | (2006.01) |
| ***F17D 1/17*** | (2006.01) |

(52) U.S. Cl.

CPC ..... *F17D 1/17* (2013.01)
USPC ..... 166/304; 166/61; 166/268; 166/302; 166/345; 166/351

(58) Field of Classification Search

CPC ..... E21B 43/01; E21B 43/017; E21B 43/20
USPC ..... 166/344, 345, 351, 366, 268, 302, 304, 166/369, 61; 137/15.07
See application file for complete search history.

(56) References Cited

U.S. PATENT DOCUMENTS 3,556,218 A * 1/1971 Talley et al. ..... 166/265
3,975,617 A 8/1976 Othmer (Continued)

FOREIGN PATENT DOCUMENTS

GB 2196716 5/1988
WO WO 01/25593 4/2001

(Continued)

OTHER PUBLICATIONS

Stoisits, R. F. et al., "Deep Water Single Production Line Tiebacks Achieving Operability Requirements While Minimizing Cost", 16$^{TH}$ Annual Deep Water Offshore Technology Conference, Nov. 30-Dec. 2, 2004, pp. 1-12, New Orleans, LA.

(Continued)

*Primary Examiner* — Matthew Buck
*Assistant Examiner* — Edwin Toledo-Duran
(74) *Attorney, Agent, or Firm* — ExxonMobil Upstream Research Company—Law Department

(57) ABSTRACT

Method of managing hydrates in a subsea production system that includes a host production facility, one or more producers, one or more water injectors, a water injection line, and a single production line for directing production fluids from the producers to the host production facility. The method comprises placing a pig in the subsea production system, shutting in production from the producers, and injecting a displacement fluid into the subsea production system in order to displace production fluids in the production line. The method also includes applying electrically resistive heat along a selected portion of the single production line to maintain production fluids within the production line at a temperature above a hydrate formation temperature after production has been shut in.

44 Claims, 18 Drawing Sheets

(56) References Cited

U.S. PATENT DOCUMENTS

| | | | | |
|---|---|---|---|---|
| 4,528,041 | A | 7/1985 | Rickey et al. | |
| 4,574,830 | A * | 3/1986 | Rickey et al. | 137/242 |
| 4,915,416 | A * | 4/1990 | Barrett et al. | 285/18 |
| 5,070,533 | A | 12/1991 | Bridges et al. | |
| 5,267,616 | A * | 12/1993 | Silva et al. | 166/311 |
| 5,289,561 | A * | 2/1994 | Costa Filho | 392/478 |
| 5,490,562 | A * | 2/1996 | Arnold | 166/267 |
| 5,536,893 | A | 7/1996 | Gudmundsson | |
| 5,816,280 | A | 10/1998 | Rojey et al. | |
| 5,842,816 | A | 12/1998 | Cunningham | |
| 5,877,361 | A | 3/1999 | Rojey et al. | |
| 5,927,901 | A | 7/1999 | Graves | |
| 5,941,096 | A | 8/1999 | Gudmundsson | |
| 6,015,929 | A | 1/2000 | Rabeony et al. | |
| 6,022,421 | A | 2/2000 | Bath et al. | |
| 6,025,302 | A | 2/2000 | Pakulski | |
| 6,139,644 | A | 10/2000 | Lima | |
| 6,152,993 | A | 11/2000 | Klomp | |
| 6,214,091 | B1 | 4/2001 | Klomp | |
| 6,264,401 | B1 * | 7/2001 | Langner et al. | 405/169 |
| 6,307,191 | B1 | 10/2001 | Waycuilis | |
| 6,336,238 | B1 | 1/2002 | Tarlton | |
| 6,350,928 | B1 | 2/2002 | Waycuilis et al. | |
| 6,371,693 | B1 | 4/2002 | Kopp et al. | |
| 6,379,612 | B1 | 4/2002 | Reizer et al. | |
| 6,412,562 | B1 * | 7/2002 | Shaw | 166/335 |
| 6,527,869 | B1 * | 3/2003 | Bourg | 134/1 |
| 6,536,461 | B2 * | 3/2003 | Decker et al. | 137/268 |
| 6,539,778 | B2 | 4/2003 | Tucker et al. | |
| 6,575,248 | B2 * | 6/2003 | Zhang et al. | 166/338 |
| 6,596,089 | B2 | 7/2003 | Smith et al. | |
| 6,656,366 | B1 | 12/2003 | Fung et al. | |
| 6,703,534 | B2 | 3/2004 | Waycuilis et al. | |
| 6,752,214 | B2 | 6/2004 | Amin et al. | |
| 6,772,840 | B2 | 8/2004 | Headworth | |
| 6,774,276 | B1 | 8/2004 | Lund et al. | |
| 6,782,950 | B2 | 8/2004 | Amin et al. | |
| 6,840,088 | B2 | 1/2005 | Tucker et al. | |
| 6,867,262 | B1 | 3/2005 | Angel et al. | |
| 6,880,640 | B2 | 4/2005 | Barratt et al. | |
| 7,008,466 | B2 | 3/2006 | Collins | |
| 7,032,658 | B2 | 4/2006 | Chitwood et al. | |
| 7,044,226 | B2 | 5/2006 | Stave | |
| 7,069,998 | B2 * | 7/2006 | Zhang et al. | 166/338 |
| 7,093,661 | B2 * | 8/2006 | Olsen | 166/357 |
| 7,234,524 | B2 | 6/2007 | Shaw et al. | |
| 7,261,810 | B2 | 8/2007 | Argo et al. | |
| 7,311,151 | B2 | 12/2007 | Chitwood et al. | |
| 7,426,963 | B2 | 9/2008 | O'Neill | |
| 7,530,398 | B2 | 5/2009 | Balkanyi et al. | |
| 2003/0056954 | A1 * | 3/2003 | Headworth | 166/302 |
| 2003/0145991 | A1 * | 8/2003 | Olsen | 166/265 |
| 2004/0149445 | A1 | 8/2004 | Appleford et al. | |
| 2004/0176650 | A1 | 9/2004 | Lund et al. | |
| 2005/0137432 | A1 | 6/2005 | Matthews et al. | |
| 2005/0145388 | A1 * | 7/2005 | Hopper | 166/357 |
| 2005/0205261 | A1 | 9/2005 | Andersen et al. | |
| 2005/0283276 | A1 * | 12/2005 | Prescott et al. | 700/282 |
| 2005/0283927 | A1 * | 12/2005 | Kinnari et al. | 15/3.5 |
| 2006/0106265 | A1 | 5/2006 | Rivers et al. | |
| 2006/0118308 | A1 * | 6/2006 | Saucier | 166/344 |
| 2006/0144595 | A1 | 7/2006 | Milligan et al. | |
| 2006/0175062 | A1 | 8/2006 | Benson | |
| 2006/0175063 | A1 * | 8/2006 | Balkanyi et al. | 166/357 |
| 2006/0218852 | A1 | 10/2006 | Graham | |
| 2006/0219412 | A1 | 10/2006 | Yater | |
| 2006/0272805 | A1 | 12/2006 | O'Malley et al. | |
| 2007/0003371 | A1 | 1/2007 | Yemington | |
| 2007/0012451 | A1 | 1/2007 | O'Neill | |
| 2008/0016909 | A1 | 1/2008 | Lu | |
| 2008/0053659 | A1 | 3/2008 | Kinnari et al. | |
| 2008/0093081 | A1 | 4/2008 | Stoisits et al. | |
| 2009/0124520 | A1 | 5/2009 | Tohidi | |
| 2009/0230025 | A1 | 9/2009 | Argo et al. | |
| 2010/0025043 | A1 * | 2/2010 | Ingebrigtsen et al. | 166/339 |

FOREIGN PATENT DOCUMENTS

| | | |
|---|---|---|
| WO | WO 02/25060 | 3/2002 |
| WO | WO 2004/083595 | 9/2004 |
| WO | WO 2006031335 A1 * | 3/2006 |
| WO | WO 2009/042319 | 4/2009 |

OTHER PUBLICATIONS

PCT/US2008/63354 International Search Report, dated Nov. 10, 2008.

* cited by examiner

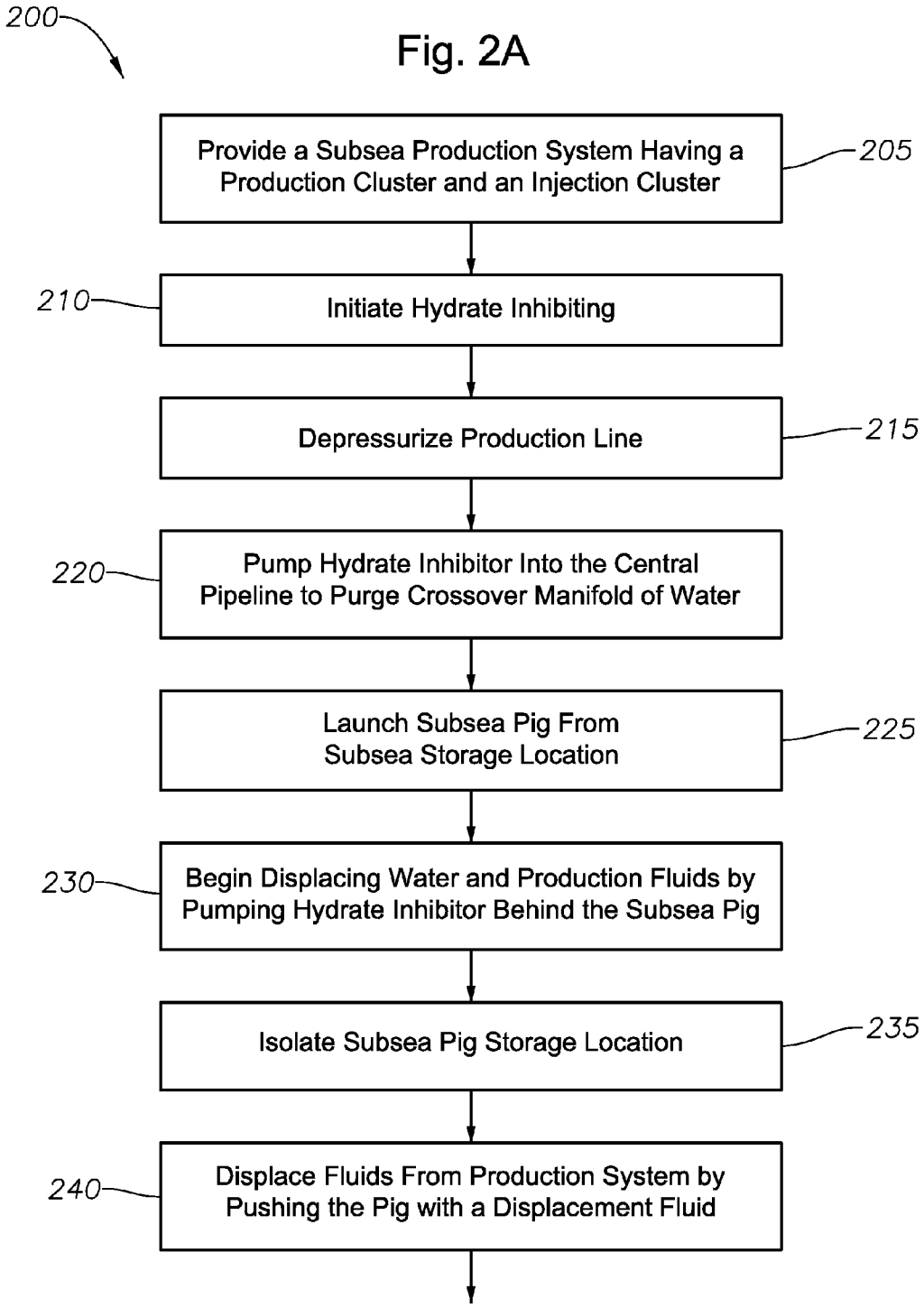
200
Fig. 2A
Provide a Subsea Production System Having a Production Cluster and an Injection Cluster
205
210
Initiate Hydrate Inhibiting
Depressurize Production Line
215
220
Pump Hydrate Inhibitor Into the Central Pipeline to Purge Crossover Manifold of Water
Launch Subsea Pig From Subsea Storage Location
225
230
Begin Displacing Water and Production Fluids by Pumping Hydrate Inhibitor Behind the Subsea Pig
Isolate Subsea Pig Storage Location
235
240
Displace Fluids From Production System by Pushing the Pig with a Displacement Fluid

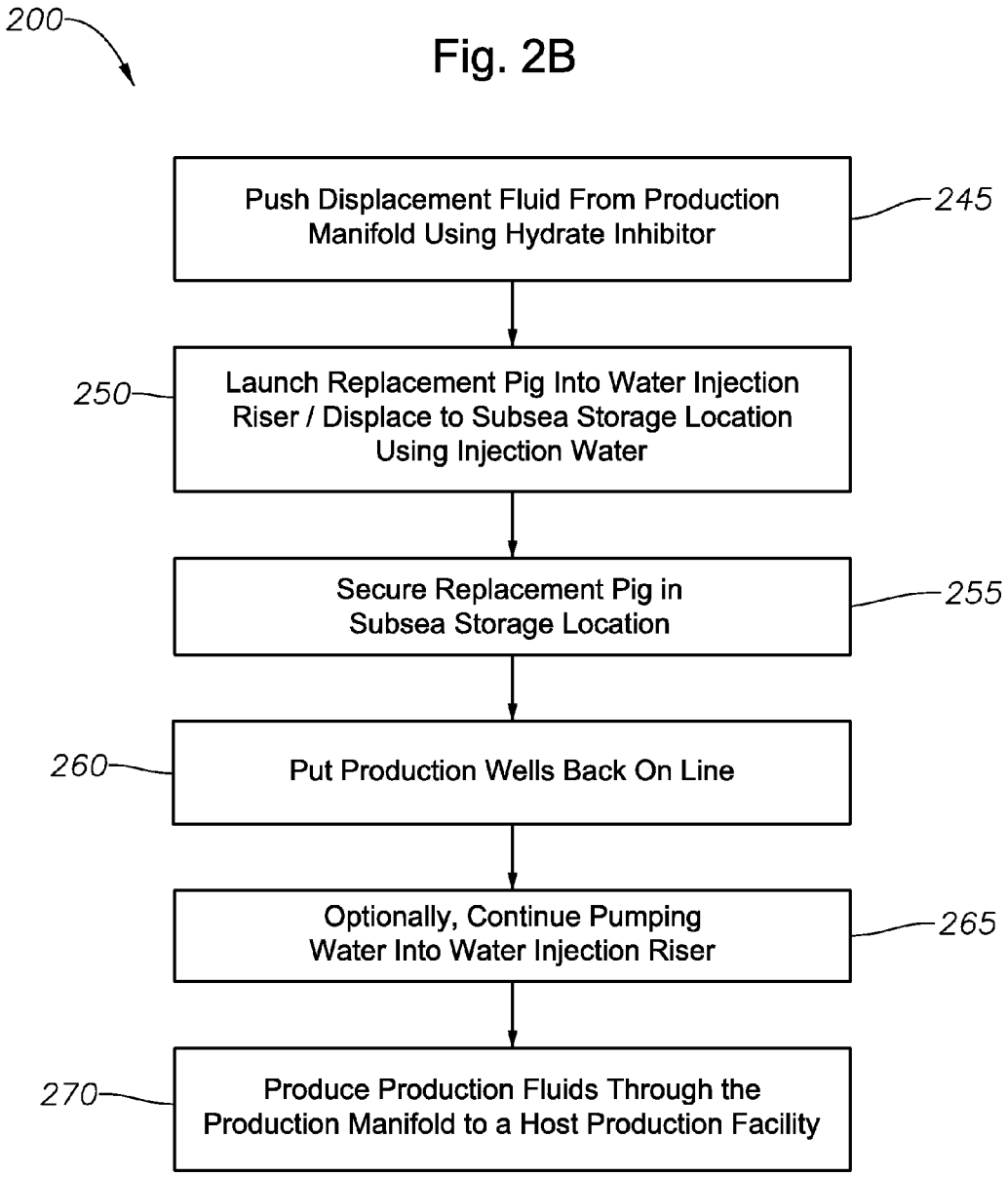
200
Fig. 2B
Push Displacement Fluid From Production Manifold Using Hydrate Inhibitor
245
250
Launch Replacement Pig Into Water Injection Riser / Displace to Subsea Storage Location Using Injection Water
Secure Replacement Pig in Subsea Storage Location
255
260
Put Production Wells Back On Line
Optionally, Continue Pumping Water Into Water Injection Riser
265
270
Produce Production Fluids Through the Production Manifold to a Host Production Facility

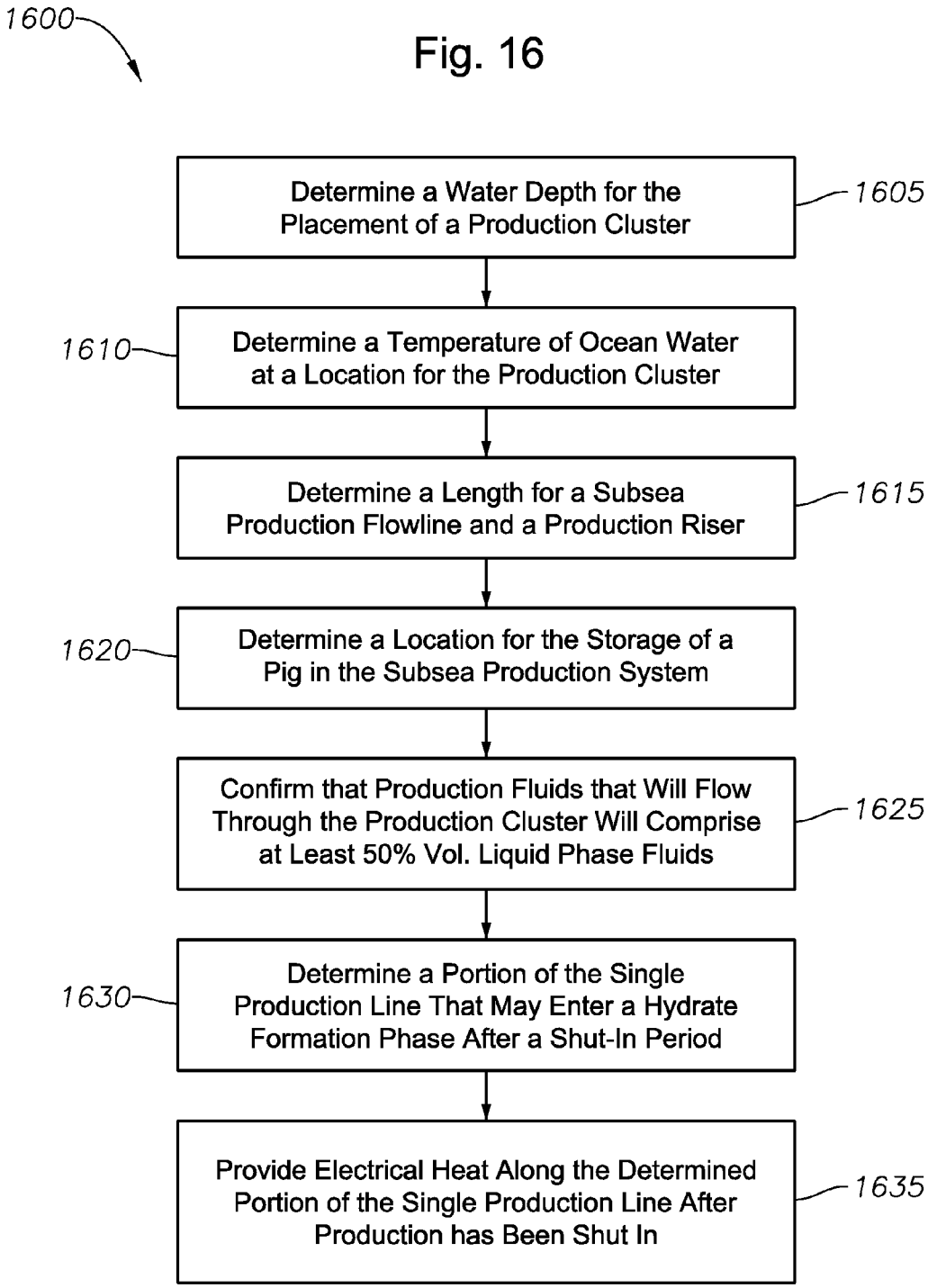
1600
Fig. 16
Determine a Water Depth for the Placement of a Production Cluster
1605
1610
Determine a Temperature of Ocean Water at a Location for the Production Cluster
Determine a Length for a Subsea Production Flowline and a Production Riser
1615
1620
Determine a Location for the Storage of a Pig in the Subsea Production System
Confirm that Production Fluids that Will Flow Through the Production Cluster Will Comprise at Least 50% Vol. Liquid Phase Fluids
1625
1630
Determine a Portion of the Single Production Line That May Enter a Hydrate Formation Phase After a Shut-In Period
Provide Electrical Heat Along the Determined Portion of the Single Production Line After Production has Been Shut In
1635

METHOD AND SYSTEM FOR FLOW ASSURANCE MANAGEMENT IN SUBSEA SINGLE PRODUCTION FLOWLINE

CROSS REFERENCE TO RELATED APPLICATIONS

This application is a continuing application that claims the benefit under 35 U.S.C. 120 and 37 C.F.R. §1.78(a) of co-pending U.S. application Ser. No. 12/676,542, entitled "Method and Apparatus for Flow Assurance Management in Subsea Single Production Flowline," filed Mar. 4, 2010, which is the national stage of International Application No. PCT/US08/73354, filed Aug. 15, 2008, which claims the benefit of U.S. Provisional 60/995,161, filed Sep. 25, 2007, which is related to U.S. Pat. No. 7,721,807 which granted on May 25, 2010, which is the U.S. application Ser. No. 11/660,777 filed Feb. 21, 2007, which is the International Application of PCT/US2005/028485 filed Aug. 11, 2005, which claims the benefit of U.S. Provisional 60/609,422 filed Sep. 13, 2004, each of which is incorporated herein by reference in its entirety.

BACKGROUND OF THE INVENTION

1. Field of the Invention

Embodiments of the present invention generally relate to the field of subsea production operations. Embodiments of the present invention further pertain to methods for managing hydrate formation in subsea equipment such as a production line.

2. Background of the Invention

More than two-thirds of the Earth's surface is covered by oceans. As the petroleum industry continues its search for hydrocarbons, it is finding that more and more of the untapped hydrocarbon reservoirs are located beneath the oceans. Such reservoirs are referred to as "offshore" reservoirs.

A typical system used to produce hydrocarbons from offshore reservoirs includes hydrocarbon-producing wells located on the ocean floor. The producing wells are sometimes referred to as "producers" or "subsea production wells." The produced hydrocarbons are transported from the producing wells to a host production facility which is located on the surface of the ocean or immediately on-shore.

The producing wells are in fluid communication with the host production facility via a system of pipes that transport the hydrocarbons from the subsea wells on the ocean floor to the host production facility. This system of pipes typically comprises a collection of jumpers, flowlines and risers. Jumpers are typically referred to in the industry as the portion of pipes that lie on the floor of the body of water. They connect the individual wellheads to a central manifold, or directly to a production flowline. The flowline also lies on the marine floor, and transports production fluids from the manifold to a riser. The riser refers to the portion of a production line that extends from the seabed, through the water column, and to the host production facility. In many instances, the top of the riser is supported by a floating buoy, which then connects to a flexible hose for delivering production fluids from the riser to the production facility.

The drilling and maintenance of remote offshore wells is expensive. In an effort to reduce drilling and maintenance expenses, remote offshore wells are oftentimes drilled in clusters. A grouping of wells in a clustered subsea arrangement is sometimes referred to as a "subsea well-site." A subsea well-site typically includes producing wells completed for production at one and oftentimes more "pay zones." In addition, a well-site will oftentimes include one or more injection wells to aid in maintaining in-situ pressure for water drive and gas expansion drive reservoirs.

The grouping of remote subsea wells facilitates the gathering of production fluids into a local production manifold. Fluids from the clustered wells are delivered to the manifold through the jumpers. From the manifold, production fluids may be delivered together to the host production facility through the flowline and then the riser. For well-sites that are in deeper waters, the gathering facility is typically a floating production storage and offloading vessel, or "FPSO." The FPSO serves as a gathering and processing facility.

One challenge facing offshore production operations is flow assurance. During production, the produced fluids will typically comprise a mixture of crude oil, water, light hydrocarbon gases (such as methane), and other gases such as hydrogen sulfide and carbon dioxide. In some instances, solid materials such as sand may be mixed with the fluids. The solid materials entrained in the produced fluids may typically be deposited during "shut-ins," i.e. production stoppages, and require removal.

Of equal concern, changes in temperature, pressure and/or chemical composition along the pipes may cause the deposition of other materials such as methane hydrates, waxes or scales on the internal surface of the flowlines, valves and risers. These deposits need to be periodically removed, as build-up of these materials can reduce internal line size and constrict flow.

Hydrates are crystals formed by water in contact with natural gases and associated liquids, in a ratio of 85 mole % water to 15% hydrocarbons. Hydrates can form when hydrocarbons and water are present at the right temperature and pressure in wells, flow lines, and valves. The hydrocarbons become encased in crystalline structures which can rapidly grow and agglomerate to sizes which can block flow. Hydrate formation most typically occurs in subsea production lines which are at relatively low temperatures and elevated pressures.

The low temperatures and high pressures of a deepwater environment cause hydrate formation as a function of gas-to-water composition. In a subsea pipeline, hydrate masses usually form at the hydrocarbon-water interface, and may accumulate as flow pushes them downstream. The resulting porous hydrate plugs have the unusual ability to transmit some degree of gas pressure, while acting as a flow hindrance to liquid. Both gas and liquid may sometimes be transmitted through the plug; however, lower viscosity and surface tension favors the flow of gas.

It is desirable to maintain flow assurance between cleanings by minimizing hydrate formation. One offshore method used for hydrate plug removal is the depressurization of the pipeline system. Traditionally, depressurization is most effective in the presence of lower water cuts. However, the depressurization process sometimes prevents normal production for several weeks. At higher water cuts, gas lift procedures may be required. Further, hydrates may quickly re-form when the well is placed back on line.

Most known deepwater subsea pipeline arrangements rely on two production lines for hydrate management. In the event of an unplanned shutdown, production fluids in the flowline and riser are commonly displaced with dehydrated dead crude oil using a pig. Displacement is completed before the production fluids (which are typically untreated or "uninhibited") cool down below the hydrate formation temperature. This prevents the creation of a hydrate blockage in the production lines. The pig is launched into one production line, is driven with the dehydrated dead crude out to the production manifold, and is driven back to the host facility through the second production line.

The two-production-line operation is feasible for large installations. However, for relatively small developments the cost of a second production line can be prohibitive. Therefore, an improved process of hydrate management is needed which does not, in certain embodiments, employ or rely upon two production lines. Further, a need exists for a hydrate management method that utilizes a water injection line and a single production line.

SUMMARY OF THE INVENTION

A method of managing hydrates in a subsea production system is provided. The subsea production system operates with a host production facility, a production cluster comprising one or more producers, a water injection cluster comprising one or more water injectors, a water injection line, and a single production line. The single production line typically includes both a subsea flow line and a production riser, and directs fluids from the production cluster to the host production facility.

In one aspect, the method includes storing a pig in the subsea production system. Storing a pig in the subsea production system may comprise placing the pig into a subsea pig launcher. The pig is later launched after a period of time. The method also includes shutting in production from the one or more producers. This is typically done before launching the pig.

The method also includes applying heat along a selected portion of the single production line. The heat is preferably electrically resistive skin-effect heating generated by flowing a current through the production riser and at least a portion of the subsea flowline. Heat is applied in order to maintain production fluids within the production line at a temperature above a hydrate formation temperature after production has been shut in.

In providing the flowline heating, the operator may determine what portion of the single production line will enter a hydrate formation phase after a shut-in period. The shut-in period may be, for example, at least 15 hours. Alternatively, the shut-in period may be at least 30 hours. The shut-in period would typically be a period of time that includes a light touch operation during cool-down. The determined portion would be identified as the selected portion of the single production line to be heated.

The method also includes injecting a displacement fluid into the subsea production system. The displacement fluid may be, for example, crude oil, diesel, or a combination thereof. Alternatively or in addition, the displacement fluid may comprise a hydrate inhibitor. The displacement fluid is injected in order to move the pig within the subsea production cluster, thereby at least partially displacing production fluids from the production cluster. The pig is moved to a location along the heated portion of the single production line.

The subsea production system may include additional components. For example, the subsea production system preferably also comprises a control umbilical having a hydrate inhibitor line and a displacement fluid service line. In this arrangement, displacement fluid may be injected into the subsea production system through the displacement fluid service line. The displacement fluid service line is preferably sized to move the pig through the subsea production line at a minimum velocity of 0.3 meters/second (1 ft/sec).

The production cluster may include not only the one or more producers, but also a production manifold. Further, the production cluster may include jumpers for providing fluid communication between the production manifold and the one or more producers. The method may then further comprise producing production fluids through the production manifold, through the single production line, and to the host production facility. The production fluids preferably comprise at least 50% vol. liquid phase fluids at the production manifold.

The single production line preferably comprises a subsea production flowline and a production riser in fluid communication with the host production facility. The production riser preferably comprises an insulated pipe-in-pipe flowline. The production line is preferably at least 10 km (6.2 miles) in length and may be over 30 km (18.4 miles) in length. A flexible hose and a buoy may optionally be connected to the production riser to aid in transporting production fluids to the host production facility.

The subsea production system also preferably includes a water injection cluster. The water injection cluster comprises one or more water injectors, and a water injection manifold. In this arrangement, the water injection line may comprise a water injection riser and a subsea flowline for receiving injection water from the host production facility.

In one optional aspect, the subsea production system further comprises one or more subsea pumps. One pump may be located along the production flowline such as near the bottom of the production riser. The method then further comprises activating the subsea pump in order to assist in pumping production fluids along the long production flowline and to the top of the water column. Alternatively or in addition, one pump may be located along a service line. The method then further comprises activating the subsea pump in order to assist in pumping the displacement fluid and move the pig.

The method may also include further injecting displacement fluid into the subsea production system in order to displace hydrate inhibitor and the pig through the single production line and to the host production facility. Preferably, the displacement fluid is a dead displacement fluid such as crude oil, diesel, or a combination thereof. Alternatively, the displacement fluid may be additional hydrate inhibitor.

In one aspect of the method, storing a pig in the subsea production system comprises injecting the pig into the water injection line, and then advancing the pig into a subsea storage location in the subsea production system using injection water. Alternatively, storing a pig in the subsea production system comprises placing the pig into the water injection cluster using a subsea pig launcher. In either instance, the method may further include storing the pig in the subsea storage location for a period of time, and launching the pig from the subsea storage location. Launching the pig may comprise advancing the pig from the subsea storage location, through the central pipeline, and to the production manifold.

After the pig has been launched from the subsea storage location, a new pig may be placed in the subsea storage location. Thus, in one aspect, the method further comprises launching a new pig from the host production facility. From there, the pig is moved through the water injection riser, through the water injection flowline, and to the subsea storage location. The pig is stored in the subsea storage location until a later time. The producers may be put back into production either before, during, or after the new pig is moved to the subsea storage location. Upon production, hydrocarbon fluids are produced from the one or more producers, through the production manifold, through the production flowline, through the production riser, and to the host production facility.

During a production line displacement procedure, it is optional to continue to inject water through the one or more injectors. In one aspect, water continues to be injected through the one or more injectors even while the pig is being moved to the subsea production cluster.

In one embodiment, the subsea production system further comprises a stand-alone manifold located near an outer end of the production flowline. This is in lieu of placing a crossover manifold between the injection manifold and the production manifold. The water injection line and the stand-alone manifold are interconnected by an extension of the water injection flowline and a smaller-bore water return line.

A method of constructing a subsea production system at a location in a marine body is also provided herein. The marine body has a water surface, and a seabed having a depth of at least 500 meters (1,640.4 feet) below the water surface. The location has a seabed temperature below 5° C. (41° F.) at the location.

In one aspect, the method comprises providing a host production facility either at the location or away from the location, and also forming a production cluster on the seabed at the location. The production cluster comprises at least one production well, with each production well having a wellhead on the seabed. The method also includes forming a water injection cluster. The injection cluster comprises at least one water injection well. The method further comprises providing a crossover manifold. The crossover manifold has a central pipeline placing the production cluster and the water injection cluster in selective fluid communication.

The method also includes providing a single production line. The single production line comprises a subsea flow line, and a production riser. Together, the subsea flow line and the production riser extend at least about 10 km (6.2 miles) from the production cluster to the host production facility. More preferably, the subsea flow line and the production riser extend at least about 30 km (18.6 miles) from the production cluster to the host production facility. The method further includes providing a water injection line from the host product facility down to the water injection cluster.

Additionally, the method includes storing a pig in a subsea storage location. Also, the method provides for shutting in production from each of the at least two production wells. Electrically resistive heat is applied along a selected portion of the single production line. This serves to maintain production fluids within the production line at a temperature above a hydrate formation temperature after production has been shut in. Preferably, the electrically resistive heat is not applied until after production is shut in.

The method also includes injecting a displacement fluid from the host production facility into a production manifold of the production cluster in order to move the pig from the subsea storage location. The pig is moved up to a location along the heated portion of the single production line. For example, the pig may be moved at least to a location proximate the beginning of the heated portion of the production line. This also displaces production fluids from the production cluster up to the portion of the single production line undergoing heating. The operator may also choose to displace the entire production line.

Finally, a method of designing a subsea production system is provided. The subsea production system operates with a host production facility, a production cluster comprising two or more producers and a production manifold, a water injection cluster comprising one or more water injectors, a water injection line, and a single production line. The single production line directs fluids from the two or more producers to the host production facility.

In one embodiment, the method includes determining a water depth for the placement of the production cluster. The method also includes determining a temperature of the water at a location for the production cluster. The method further includes determining a combined length for a subsea production flowline and a production riser. The production flowline and the production riser together comprise the single production line. The single production line has a length that is at least 10 km (6.2 miles).

The method additionally comprises determining a location for the storage of a pig in the subsea production system. Further, the method includes confirming that production fluids that will flow through the production cluster will comprise at least 50% vol. liquid phase fluids.

The method will also include the step of determining a portion of the single production line that may enter a hydrate formation phase after a shut-in period. Determining a portion of the single production line that may enter a hydrate formation phase may take into consideration a number of different factors. These include (i) fluid pressure within the subsea production flowline, (ii) production fluid composition; (iii) fluid temperature within the flowline, (v) seabed incline, (vi) temperature gradient within the water column, or (vii) combinations thereof.

The shut-in period is at least 15 hours. Thereafter, the method includes applying electrical heat to the determined portion of the single production line after production has been shut in.

BRIEF DESCRIPTION OF THE DRAWINGS

So that the manner in which the features of the present invention can be better understood, certain flow charts, drawings, and graphs are appended hereto. It is to be noted, however, that the drawings illustrate only selected embodiments of the inventions and are therefore not to be considered limiting of scope, for the inventions may admit to other equally effective embodiments and applications.

FIGS. 2A and 2B present a combined flowchart demonstrating steps for performing a hydrate management process, in one embodiment.

FIG. 5 is another plan view of the subsea production system of FIG. 3. Here, light-touch operations have begun in order to prepare the production cluster for shut-in.

FIG. 16 is a flowchart for a method of designing a subsea production system, in one embodiment.

DETAILED DESCRIPTION OF CERTAIN EMBODIMENTS

Definitions

Figure 1:
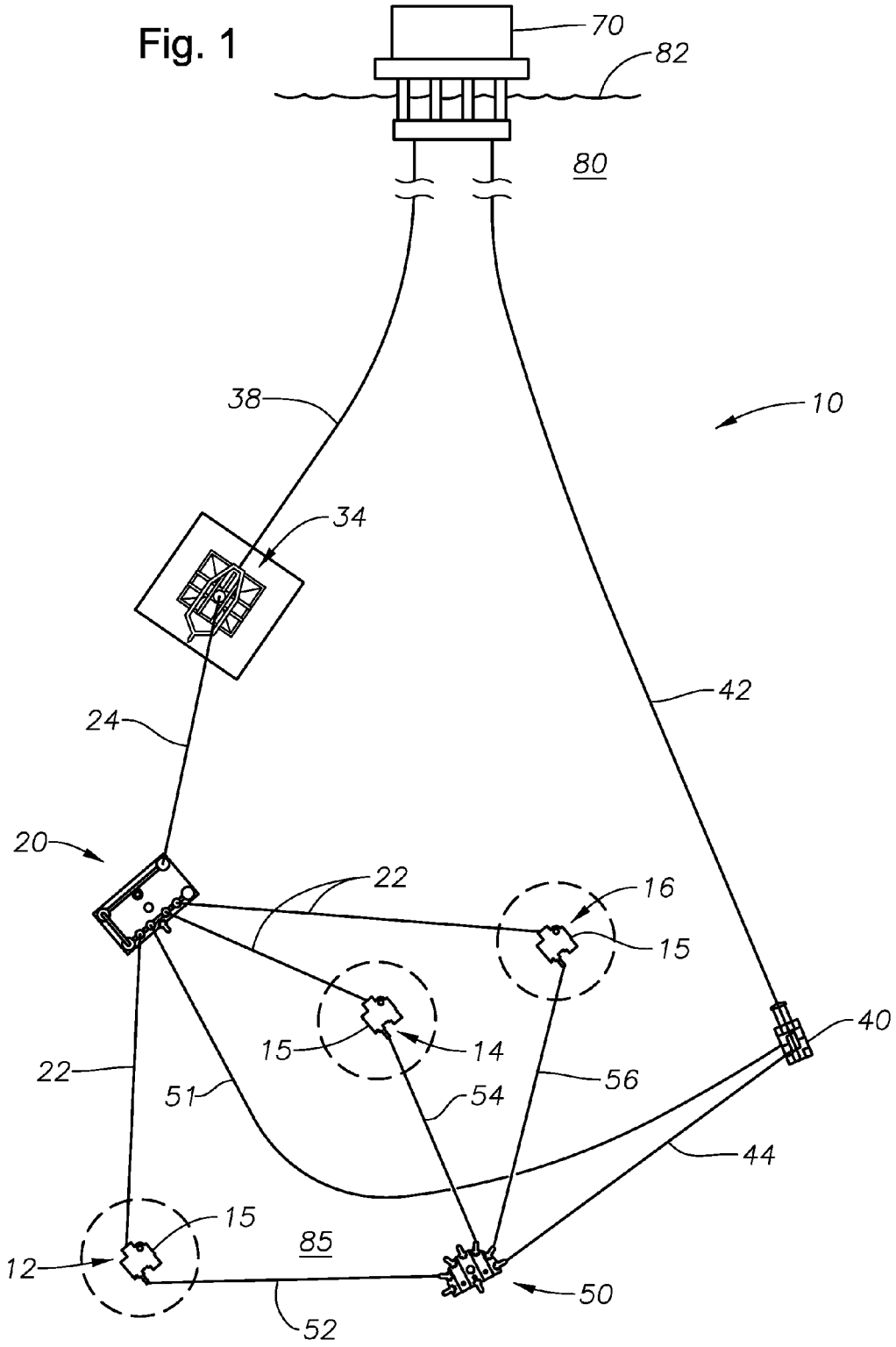
FIG. 1 is a perspective view of a subsea production system utilizing a single production line and a utility umbilical line. The system is in production.

As used herein, the term "displacement fluid" refers to a fluid used to displace another fluid. Preferably, the displacement fluid has no hydrocarbon gases. Non-limiting examples include dead crude and diesel.

The term "umbilical" refers to any line that contains a collection of smaller lines, including at least one service line for delivering a working fluid. The "umbilical" may also be referred to as an umbilical line or a control umbilical. The working fluid may be a chemical treatment such as a hydrate inhibitor or a displacement fluid. The umbilical will typically include additional lines, such as hydraulic power lines and electrical power cables.

The term "service line" refers to any tubing within an umbilical. The service line is sometimes referred to as an umbilical service line, or USL. One example of a service line is an injection tubing used to inject a chemical.

The term "low dosage hydrate inhibitor," or "LDHI," refers to both anti-agglomerates and kinetic hydrate inhibitors. It is intended to encompass any non-thermodynamic hydrate inhibitor.

The term "production facility" means any facility for receiving produced hydrocarbons. The production facility may be a ship-shaped vessel located over a subsea well site, an FPSO vessel (floating production, storage and offloading vessel) located over or near a subsea well site, a near-shore fluid separation facility, or even an on-shore separation facility. Synonymous terms include "host production facility" and "gathering facility."

The terms "tieback," "tieback line," "riser," and "production line" may be used interchangeably herein, and are intended to be synonymous. These terms mean any tubular structure or collection of lines for transporting produced hydrocarbons to a production facility. A production line may include, for example, a subsea production flowline, a riser, spools, and top-side hoses.

The term "production line" means a riser and any other pipeline used to transport production fluids to a production facility. A pipeline may include, for example, a flexible jumper or a subsea production flowline.

"Subsea production system" means an assembly of production equipment placed in a marine body. The marine body may be an ocean environment, or it may be, for example, a fresh water lake. Similarly, "subsea" includes an ocean body, a sea, and a deepwater lake.

"Subsea equipment" means any item of equipment placed below the water surface of a marine body as part of a subsea production system. Such equipment may include production equipment and water injection equipment.

"Subsea well" means a well that has a tree below the water surface, such as at an ocean bottom or seabed. "Subsea tree," in turn, means any collection of valves disposed over a wellhead in a water body.

"Manifold" means any item of subsea equipment that gathers produced fluids from one or more subsea trees, and delivers those fluids to a production line, either directly or through another line such as a jumper line.

"Inhibited" means that produced fluids have been mixed with or otherwise been exposed to a chemical inhibitor for inhibiting the formation of gas hydrates including natural gas hydrates. Conversely, "uninhibited" means that produced fluids have not been mixed with or otherwise been exposed to a chemical inhibitor for inhibiting formation of gas hydrates.

Description of Selected Specific Embodiments

FIG. 1 provides a perspective view of a subsea production system 10 which may be used to produce hydrocarbons from a subterranean offshore reservoir. The system 10 utilizes a single production flowline, including a riser 38. Oil, gas and, typically, water, referred to as production fluids, are produced through the production riser 38. In the illustrative system 10, the production riser 38 is an 8-inch insulated production line. However, other sizes may be used. Thermal insulation is provided for the production riser 38 to maintain warmer temperatures for the production fluids and to inhibit hydrate formation during production. Preferably, the production line protects against hydrate formation over a minimum of 20 hours of cool-down time during shut-in conditions.

The production system 10 includes one or more subsea wells. In this arrangement, three wells 12, 14 and 16 are shown. The wells 12, 14, 16 may include at least one injection well and at least one production well. In the illustrative system 10, wells 12, 14, and 16 are all producers, thereby forming a production cluster.

Each of the wells 12, 14, 16 has a subsea tree 15 on a marine floor 85. The trees 15 deliver production fluids to jumpers 22, or short flowlines. The jumpers 22, in turn, deliver production fluids from the respective production wells 12, 14, 16 to a manifold 20. The manifold 20 is an item of subsea equipment comprised of valves and piping in order to collect and then distribute fluids. Fluids produced from the production wells 12, 14, 16 are usually commingled at the manifold 20, and exported from the well-site through a subsea production jumper 24 and the production riser 38.

The production riser 38 ties back to a production facility 70. The production facility, also referred to as a "host facility" or a "gathering facility," is any facility where production fluids are collected. The production facility may be, for example, a ship-shaped vessel capable of self-propulsion in the ocean. The production facility may alternatively be fixed to land and reside near shore or immediately on-shore. However, in the illustrative system 10, the production facility 70 is a floating production, storage and offloading vessel (FPSO) moored in the ocean. The FPSO 70 is shown positioned in a marine body 80, such as an ocean, having a surface 82 and a marine floor 85. In one aspect, the FPSO 70 is 3 to 15 kilometers from the manifold 20.

In the arrangement of FIG. 1, a production sled 34 is also used. The optional production sled 34 connects the jumper 24 with the production riser 38. A flexible hose (not seen in FIG. 1) may further be used to facilitate the communication of fluids between the riser 38 and the FPSO 70.

The subsea production system 10 also includes a utility umbilical 42. The utility umbilical 42 represents an integrated electrical/hydraulic control line. Utility umbilical line 42 typically includes conductive wires for providing power to subsea equipment. A control line within the umbilical 42 may carry hydraulic fluid to a subsea distribution unit (SDU) 50 used for controlling items of subsea equipment such as the subsea manifold 20, and trees 15. Such control lines allow for the actuation of control valves, chokes, downhole safety valves, and other subsea components from the surface. Utility umbilical 42 also includes a chemical injection tubing or service line which transmits chemical inhibitors to the ocean floor, and then to equipment of the subsea production system 10. The inhibitors are designed and provided in order to ensure that flow from the wells is not affected by the formation of solids in the flow stream such as hydrates, waxes and scale. Thus, the umbilical 42 will typically contain a number of lines bundled together to provide electrical power, control, hydraulic power, fiber optics communication, chemical transportation, or other functionalities.

The utility umbilical 42 connects subsea to an umbilical termination assembly ("UTA") 40. From the umbilical termination assembly 40, flying lead 44 is provided, and connects to a subsea distribution unit ("SDU") 50. From the SDU 50, flying leads 52, 54, and 56 connect to the individual wells 12, 14, and 16, respectively.

In addition to these lines, a separate umbilical line 51 may be directed from the UTA 40 directly to the manifold 20. A displacement fluid service line (not seen in FIG. 1) is placed in both of service umbilical lines 42 and 51. The service line is sized for the pumping of a displacement fluid. During shut-in, and during a hydrate management operation, the displacement fluid is pumped through the displacement fluid service line, through the manifold 20, and into the production riser 38 in order to displace produced hydrocarbon fluids before hydrate formation begins.

The displacement fluids may be dehydrated and degassed crude oil. Alternatively, the displacement fluids may be diesel. In either instance, an additional option is to inject a traditional chemical inhibitor such as methanol, glycol or MEG before the displacement fluid.

It is understood that the architecture of system 10 shown in FIG. 1 is illustrative. Other features may be employed for producing hydrocarbons from a subsea reservoir and for inhibiting the formation of hydrates. Indeed, in the present system shown at 300 in various figures that follow, a number of additional items of equipment such as flow-control valves are described.

FIGS. 2A and 2B together present a unified flowchart demonstrating steps for performing a hydrate management method 200 of the present invention, in one embodiment. The method 200 is performed using a subsea production system having a single production line. The method 200 first includes the step of providing a subsea production system. This step is illustrated at Box 205. In operation, the subsea production system generally includes a production cluster and an injection cluster.

Figure 3:
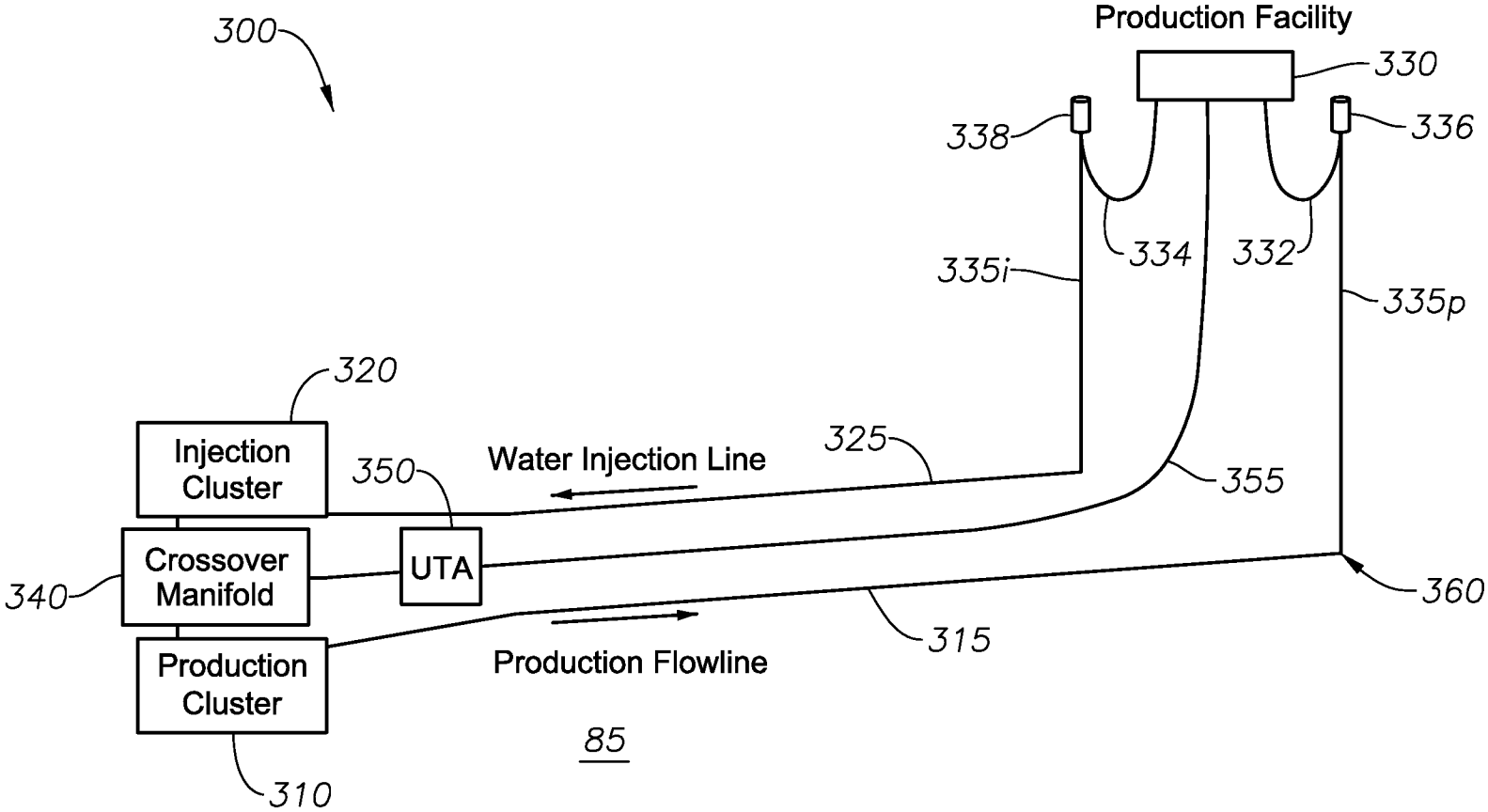
FIG. 3 is a side view of a production line, a water injection line and a utility umbilical line. The view is generally schematic, and shows a subsea production system in production and a water injection system injecting water.

FIG. 3 presents a schematic view of a subsea production system 300 as may generally be used in practicing the method 200. It can be seen in the arrangement of FIG. 3 that the production system 300 includes a production cluster 310 and an injection cluster 320. The production cluster 310 generally comprises one or more production wells (or "producers"), and a production manifold. Similarly, the injection cluster 320 generally includes one or more subsea injection wells (or "injectors") and an injection manifold. The production cluster 310 and the injection cluster 320 are illustrated in greater detail in FIGS. 4 through 12, discussed below.

The subsea production system 300 also includes a production facility 330. Typically, the production facility 330 will be either (1) a ship-shaped floating production, storage and offloading vessel (or "FPSO"), or (2) a semi-submersible vessel, (3) a tension-leg platform vessel, or (4) a deep-draft caisson vessel. However, the present methods are not limited by the nature or configuration of the host production facility 330. Indeed, the production facility 330 may be a near-shore facility.

The production cluster 310 is placed in fluid communication with the production facility 330 by a production line. The production line generally comprises a production flowline 315 along the marine floor, and a production riser 335*p*. Similarly, the injection cluster 320 is placed in fluid communication with the production facility by means of a water injection line. The water injection line generally comprises an injection flowline 325 along the marine floor, and a water injection riser 335*i*.

The production flowline 315 is preferably insulated. More specifically, the production flowline 315 is preferably a rigid steel pipe-in-pipe insulated flowline. It is also preferred that the various jumpers and trees used in the subsea production cluster 310 be insulated. The insulation is designed such that the produced fluids do not enter hydrate formation conditions during steady state conditions at the anticipated minimum flow rates for the produced fluids. However, the water injection flowline 325 is preferably a rigid steel uninsulated flowline.

For the production riser 335*p*, the connection to the production facility 330 may include a length of flexible production hose 332. Similarly, for the injection line 335*i*, the connection to the production facility 330 may include a length of flexible injection hose 334. This is particularly true if a riser tower (not shown) is used. It is understood that the connection between the production riser 335*p* and the flexible production hose 332 is typically at or near a buoy 336. Similarly, it is understood that the connection between the water injection riser 335*i* and the flexible injection hose 334 is typically at or near a separate buoy 338.

Next, the production system 300 preferably includes a "crossover manifold" 340. The crossover manifold 340 defines an arrangement of pipes and valves that provide selective fluid communication between the production manifold in the production cluster 310 and the injection manifold in the injection cluster 320. The crossover manifold 340 also provides a connection path between the water injection flowline 325 and the production flowline 315 for the purpose of moving a pig from the injection cluster 320 to the production cluster 310. The pig is shown at 345 in FIG. 4. Greater details concerning features of the crossover manifold 340, the injection cluster 320, the production cluster 310, and the pig 345 are discussed in connection with FIG. 4, below.

In the view of FIG. 3, the crossover manifold 340 is indicated as a component separate from the production cluster 310 and the injection cluster 320. However, it is understood that the crossover manifold 340 may share certain valves and lines with the production cluster 310 and/or the injection cluster 320.

The subsea production system 300 also may include an umbilical 355. The umbilical 355 may comprise one or more chemical injection tubings, one or more electrical power lines, one or more electrical communication lines, one or more hydraulic fluid lines, a fiber optics communication line, and an oil injection tubing. The chemical injection tubing within the umbilical 355 transmits a hydrate inhibitor to the ocean floor, and then to production equipment of the subsea production system 300. Similarly, the oil injection tubing transmits a displacement fluid such as dead crude or diesel to the ocean floor. Thus, the umbilical 355 contains a number of lines bundled together to provide integrated electrical power, control, hydraulic power, chemical transportation, or other functionalities.

An umbilical termination assembly 350 is also provided in the system 300. The umbilical termination assembly ("UTA") 350 is preferably landed on the ocean bottom proximate the crossover manifold 340. The umbilical 355 is connected at an upper end to the host production facility 330, and at a lower end to the UTA 350.

Various other features may optionally be included in the subsea production system 300. For example, the production flowline 315 may include a gas lift injection system. An example of a gas lift injection point is shown at 360. Gas is injected at the base of the production riser 335*p* to help carry fluids to the production facility 330, if necessary.

Figure 4:
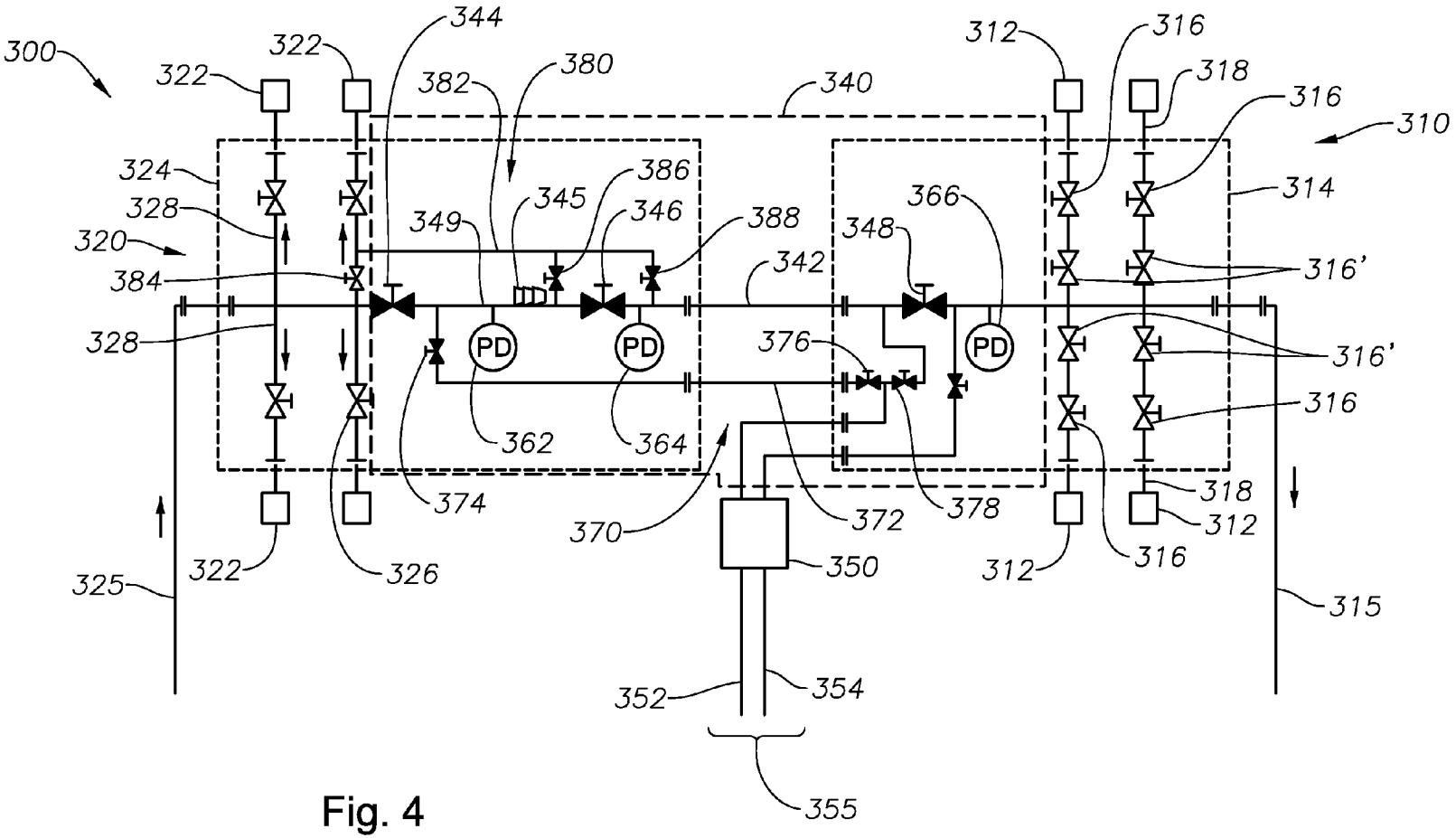
FIG. 4 is a plan view of the production system of FIG. 3. In this view, production fluids are being transported away from a production cluster through a single production line, water is being transported to a water injection cluster, and a utility umbilical is transporting control fluid, chemicals and displacement fluids to the crossover manifold between the production and water injection clusters.

FIG. 4 is a plan view of a subsea portion of the production system 300 of FIG. 3. In this view, the subsea production system 300 is "on-line." Production fluids are being transported through the production flowline 315 and to the host production facility 330 (not seen in FIG. 4). It is noted that a single production flowline 315 is employed in the subsea production system 300.

Greater details concerning the production cluster 310, the injection cluster 320, and the crossover manifold 340 are seen in FIG. 4. First, the production cluster 310 includes a plurality of producers 312. In the illustrative arrangement 300, four separate producers 312 are seen. However, any number of production wells may be utilized in the method 200 of the present invention.

The producers 312 are in fluid communication with a production manifold 314. The production manifold 314 comprises a body having a number of valves 316 for controlling the flow of fluid therethrough. Jumpers 318 provide fluid communication between the producers 312 and the valves 316 of the production manifold 314. Optionally, and as shown in FIG. 4, two sets of valves 316 are provided in-line with each jumper 318: (1) valves 316 adjacent the producers 312, and (2) intermediate valves 316' adjacent the manifold 314. This allows the jumpers 318 to be inhibited without completely opening them to the flow of production fluids.

Next, referring to the injection cluster 320, the injection cluster 320 first includes one or more injectors 322. In the illustrative arrangement of the production system 300, four separate injectors 322 are provided. However, any number of water injection wells 322 may be utilized.

The injection cluster 320 includes a water injection manifold 324. The water injection manifold 324 defines a plurality of valves 326 for providing selective fluid communication with the various injectors 322. Fluid communication is provided through separate jumpers 328.

Of particular interest, a pig 345 is seen within the injection cluster 320. Pigging capability is provided to improve displacement efficiency when displacing the production flowline 315 at the beginning of a long-term shutdown. Preferably, the pig 345 is a batching pig that is fabricated from an elastomeric material that will avoid degradation during storage in a cold, fluid environment. Preferably, the pig 345 will also have the capability of scraping deposited solids from the interior of the production flowline.

The pig 345 is initially transported from the host production facility 330 to a subsea storage location 349 through the water injection line 335*i*/325. The pig 345 remains in the subsea storage location 349 during production. More specifically, the pig 345 remains in the subsea storage location 349 until hydrate management steps in the method 200 begin in connection with a long-term shutdown. As part of the hydrate management method 200, the pig 345 is "launched" from the subsea storage location 349 in order to displace live hydrocarbon fluids from the production line 315/335*p*. The launching of the pig 345 is described further in connection with a discussion of the step of Box 225, below.

Also seen in the production system 300 of FIG. 4 is the crossover manifold 340. In the arrangement 300, the crossover manifold 340 is shown in dashed lines. This is to represent that the crossover manifold 340 is integrally connected with the production manifold 314 and the water injection manifold 324.

The crossover manifold 340 defines a series of valves and pipes. First, a central pipeline 342 is shown. The central pipeline 342 places the production cluster 310 and the water injection cluster 320 in selective fluid communication. Three valves 344, 346 and 348 are seen along central pipeline 342. Valve 344 is a master injection manifold valve; valve 346 is a master crossover manifold valve; and valve 348 is a master production manifold valve. As will be described further below, operation of valves 344, 346, 348 controls the movement of fluids and the movement of the pig 345 from the water injection manifold 324 to the production manifold 314.

It can be seen in FIG. 4 that each of the valves 344, 346, 348 is darkened. This indicates that each of the valves 344, 346, 348 is in a closed position. Thus, fluid is prohibited from flowing through the central pipeline 342.

An optional feature in the production system 300 is the use of pig detectors. Several pig detectors are seen in FIG. 4. First, pig detectors 362 and 364 are seen along the water injection manifold 324. Further, pig detector 366 is shown along production manifold 314. The pig detectors 362, 364, 366 provide confirmation to the operator concerning the movement of the pig 345 through the system 300 in connection with the hydrate removal method 200. Pig detectors 362 and 364 specifically provide positive indication of pig 345 arrival and departure in the subsea storage location 349. Pig detector 366 provides confirmation of arrival of the pig 345 in the production manifold 314. Notably, the pig detector 366 is positioned at a point beyond the injection point of displacement fluid from the control umbilical 355.

The crossover manifold 340 may be configured in two ways: If the field is developed with both a production manifold 314 and a water injection manifold 324, then the crossover manifold 340 is preferably split, with some components on the production manifold 314, and other components on the water injection manifold 324. The two manifolds 314, 324 are optionally interconnected with a central pipeline 342 and a kicker line 372 for methanol.

As an alternative, the field may be developed with in-line tees (without separate water injection and production manifolds). In this instance, the crossover system 340 consists of a stand-alone manifold located near the outer end of the production flowline 315. The water injection flowline 325 and the crossover manifold 340 are interconnected by an extension of the water injection flowline 315, and a smaller-bore water return line (not shown).

Also visible in FIG. 4 is a UTA 350. The UTA is seen in fluid communication with the control umbilical 355. Two representative lines are seen making up the control umbilical 355. These represent (1) a chemical injection service line 352, and (2) a displacement fluid service line 354. The chemical injection line 352 primarily serves as a hydrate inhibitor line. Preferably, the displacement fluid service line 354 has a minimum inner diameter of three inches in order to accommodate a small pig. The maximum allowable operating pressure of the displacement fluid service line 354 should be not less than 5,000 psig for a 3-inch ID service line. The displacement fluid service line 354 provides a displacement fluid for displacing live production fluids from the production flowline 315. The displacement fluid service line 354 should be piggable for management of wax deposits.

It is understood that the control umbilical 355 will likely contain a number of other lines comprised of electro-hydraulic steel tube umbilicals. These may include hydraulic power control lines, electrical lines with power/communication conductors, fiber optic lines, methanol injection lines, and other chemical injection lines. The control umbilical 355 connects to the host production facility 330, with the connection configured to include a pig launcher for moving a small pig through the service line 354. The subsea umbilical termination assembly (UTA) 350 is designed to allow passage of a smaller-diameter pig from the displacement fluid service line 354 into the production flowline 315.

The various lines within the control umbilical 355 extend from the FPSO 330 to the ocean bottom. Preferably, the lines (such as lines 352 and 354) are manufactured in a continuous length, including both dynamic and static sections. The transition from a dynamic to a static section of the control umbilical 355 is as small as possible, and may consist of taper-to-end armor layers, if applicable. The umbilical lines (such as lines 352 and 354) may be installed in I-tubes mounted on the hull of the FPSO 330, and terminating below top-side umbilical termination assemblies (TUTA) (not shown). Each umbilical line is preferably provided with a bend stiffener at the "I" tube exit.

FIG. 4 also shows a separate production flowline 315 and water injection flowline 325. The production flowline 315 receives produced fluids from the production manifold 314. The water injection flowline 325 delivers water to the water injection manifold 324.

In the production stage shown in FIG. 4 and represented in the step of Box 205, the subsea production system 300 is in production. Water is being delivered from the production facility 330, through the water injection riser 335*i* (shown in FIG. 3), through the water injection flowline 325, and down to the water injection manifold 324. Valves 326 are open, permitting injected water to flow to the various injectors 322. From there, it is understood that water is injected through the injectors 322 into one or more formations, either for disposal purposes or for purposes of maintaining reservoir pressure or providing sweep.

During the production stage of FIG. 4, the master water injection manifold valve 344 and the crossover manifold valve 346 are closed. This prevents the pig 345 from moving through the crossover manifold 340. It also forces water to be moved through the water injection jumpers 328 and into the injectors 322.

On the production side, the various producers 312 are also in operation. Production valves 316 are in an open position, permitting production fluids to flow under pressure from the producers 312, through the production jumpers 318, and to the production flowline 315. Production fluids then travel upward through the production riser 335*p* (shown in FIG. 3) in the water column and to the host production facility 330.

It is noted here that the master production manifold valve 348 is also in its closed position. This prevents production fluids from backing up to the central pipeline 342 within the crossover manifold 340.

The subsea production system 300 also includes a crossover displacement system 370. The crossover displacement system 370 provides a mechanism to direct a displacement fluid behind the pig 345. The displacement fluid moves the pig 345 from the subsea storage location 349 and through the central pipeline 342 connecting the water injection manifold 324 and the production manifold 314. In this instance, the displacement fluid is preferably a hydrate inhibitor.

The crossover displacement system 370 first comprises a crossover displacement flowline 372. The crossover displacement flowline 372 also connects the water injection manifold 324 and the production manifold 314. The crossover displacement flowline 372 serves as a conduit for sending hydrate inhibitor from the chemical injection line 352 to a point in the subsea storage location 349 behind the pig 345.

The crossover displacement system 370 also comprises a series of valves. These represent a first valve 374, a second valve 376, and a third valve 378. As will be further described below, these valves 374, 376, 378 facilitate the circulation of the displacing fluid using a hydrate inhibitor pumped through the chemical injection line 352. In the operational production stage of FIG. 4, each of valves 374, 376, 378 is darkened, indicating a closed position.

As noted above, the subsea production system 300 also comprises a subsea storage location 349. The subsea storage location 349 defines a section of pipe located between the water injection manifold valve 344 and the crossover manifold valve 346. The subsea storage location 349 serves as a holding place for the pig 345 during production operations.

In addition, the subsea production system 300 includes a water injection return system 380. The water injection return system 380 is normally closed. However, the water injection return system 380 is opened in connection with the launching of a replacement pig (seen at 345' in FIG. 10). This occurs after hydrate management procedures 200 have been completed and the subsea production system 300 is ready to be put back into production.

The water injection return system 380 comprises a return line 382, a first return valve 384, a second return valve 386, and a third return valve 388. In the operational arrangement of FIG. 4, the first return valve 384 is open, while the second 386 and third 388 return valves are closed. Operation of the water injection return system 380 and the storage of a replacement pig 345' is discussed further below in connection with FIG. 10 and the step of Box 250.

Various valves have been identified herein for the subsea production system 300. It is understood that the valves related to the production cluster 310, the injection cluster 320, the crossover manifold system 340, the UTA 350, the crossover displacement system 370, and the water injection return system 380 are remotely controlled. Typically, remote control is provided by means of electrical signals and/or hydraulic fluid.

Referring again to FIG. 2, the method 200 next includes the step of initiating hydrate inhibiting. This step is illustrated in Box 210 of FIG. 2A, and may be referred to as "light touch operations." The purpose of the light touch operations is to inject a hydrate inhibitor into the production manifold 314, valves 316, jumpers 318, and wells 312. This, in turn, prevents hydrate formation once production fluids are no longer flowing through the production cluster 310.

Figure 5:
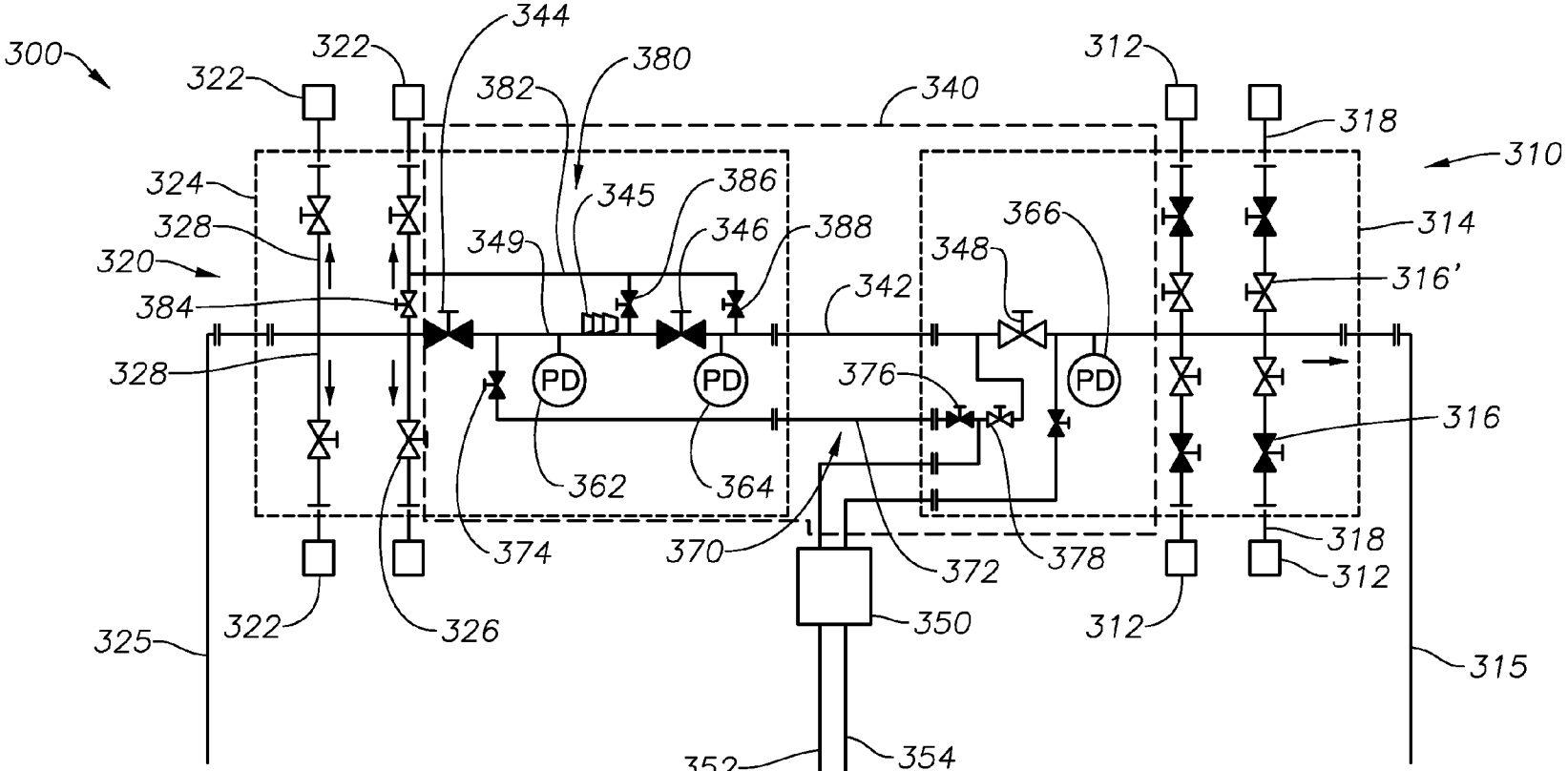

FIG. 5 is another plan view of the production system of FIG. 3. The subsea production system 300 is seen. FIG. 5 demonstrates implementation of the step of Box 210. Here, light-touch operations have begun. The injectors may continue to function with the water injection valves 326 remaining open. However, the producers 312 are shut in to production due to system shut-down. Shut-in is done by closing production valves 316. In the view of FIG. 5, valves 316 are darkened to indicate a closed state.

In order to provide the inhibitor, a hydrate inhibiting chemical such as methanol is pumped under pressure from the production facility 330 and through the chemical injection service line 352. Valves 374 and 376 of the crossover displacement system 370 remain closed, while valve 378 is opened. In addition, the master production manifold valve 348 and intermediate production valves 316' are opened. Hydrate inhibitor may then be pumped into the production cluster 310 up to production valves 316. Production valves 316 and jumpers 318 will be treated by the hydrate inhibitor pumped through lines from the production trees and then closed after the operation is complete.

It is noted that for either planned or unplanned shutdowns, the production flowline 315 is preferably depressurized. Depressurization may take place after an established time has elapsed after shut-down. This step is shown in Box 215 of FIG. 2A.

To conduct depressurization, the production valves 316 are closed but the discharge end of the production riser 335*p* (shown in FIG. 3) remains open. As pressure drops, methane and other gases in the production fluids break out of solution. The gas breaking out of solution may be temporarily flared at the production facility, or stored for later use as fuel or for commercial sale. For example, recovered gases may be routed to a flare scrubber or to a high pressure flare header (not shown) at the host production facility 330. The removal of gas and depressurization of the production flowline serves to further inhibit the formation of hydrates in the production flowline 315.

Preferably, the subsea production system 300 is designed to allow the system 300 to be depressurized to a pressure below that at which hydrates will form at sea water temperature at the depth of interest on both the upstream and downstream sides of any blockage. Depressurization on the upstream (producer) side of a hydrate blockage may be accomplished via the crossover manifold 340 and the umbilical 355. First, the displacement fluid service line 354 is emptied by injecting hydrocarbon gas from a high-pressure gas injection manifold on the production facility 330. The hydrocarbon gas forces fluids from the displacement fluid service line 354 through the crossover manifold 340 and into a production well 312 or a water injection well 322. Pressure is then released, allowing the gas to flow back out of the displacement fluid service line 354. This depressurization process may be repeated as necessary to completely remove liquids from the fluid displacement service line 354 and to depressurize the production flowline 315 to the lowest achievable pressure.

The method 200 next includes the step of pumping a hydrate inhibitor into the central pipeline 342. The purpose is to purge the central pipeline 342 of water. This step is illustrated in Box 220 of FIG. 2A.

Figure 6:
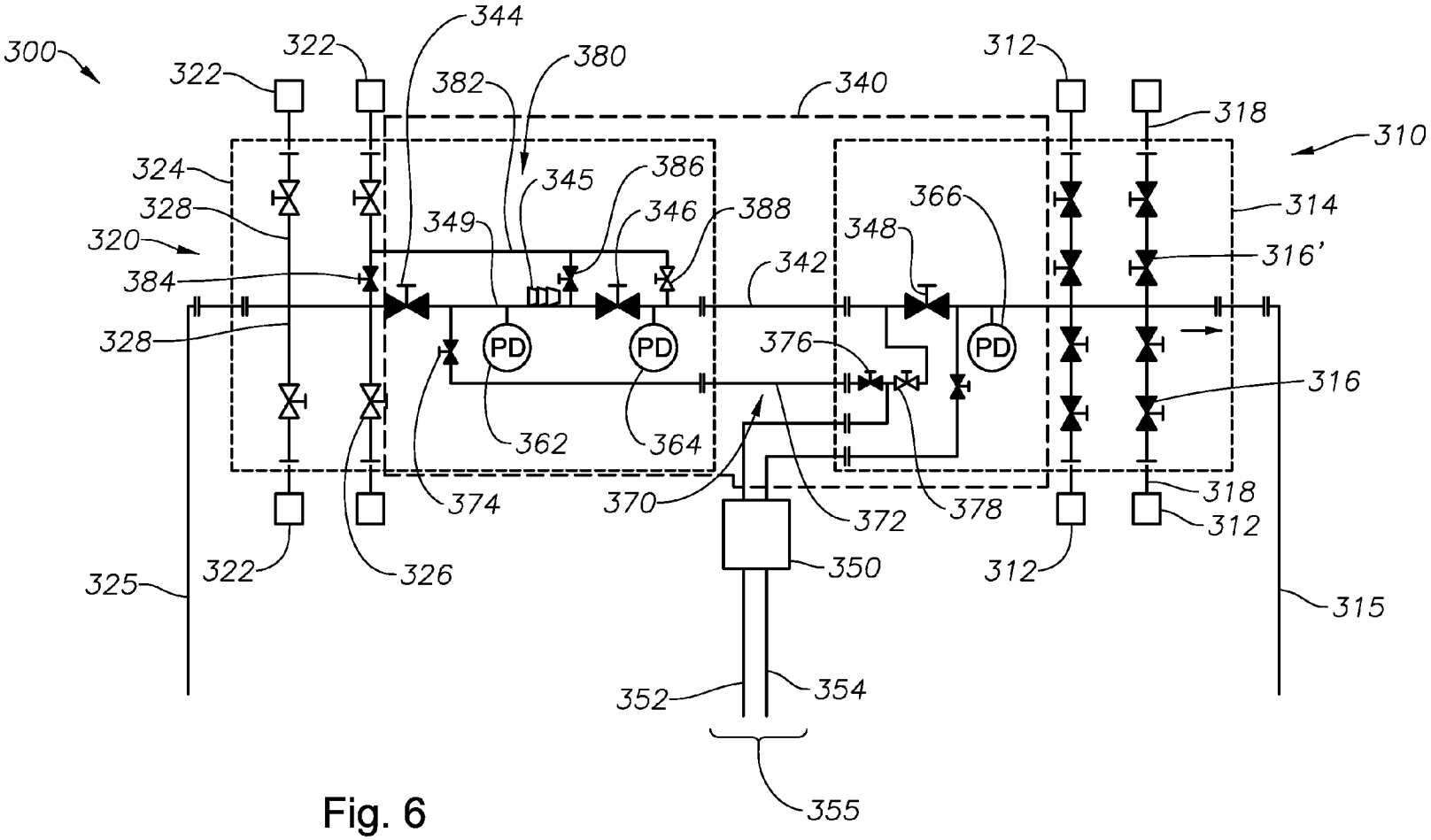
FIG. 6 is another plan view of the production system of FIG. 3. Here, a hydrate inhibitor is being pumped to purge a line connecting a water injection manifold with a production manifold.

FIG. 6 is another plan view of the production system of FIG. 3. The subsea production system 300 is again seen. FIG. 6 demonstrates implementation of the step of Box 220. Here, a hydrate inhibitor is being pumped into the central pipeline 342. The displacement step 220 serves to purge water from the central pipeline 342 connecting the water injection manifold 324 and the production manifold 314.

In performing the water displacement step of Box 220, the master water injection valve 344 and the master crossover valve 346 remain closed. In this way, the pig 345 remains secure in the subsea storage location 349. The chemical inhibitor is pumped through chemical injection line 352, and displaces water through the water injection return system 380. The third return valve 388 is opened, causing water and hydrate inhibitor to flow through the return line 382. Displaced water flows into one of the water injection wells 322 via open injection valves 326. The third return valve 388 is then closed.

The method 200 next includes the step of launching the subsea pig 345. This step is illustrated in Box 225 of FIG. 2A. The pig 345 is normally maintained in the subsea storage location 349. The step of Box 225 of launching the pig 345 involves moving the pig 345 from the subsea storage location 349 towards the production manifold 314.

Related to the step of Box 225 of launching the pig 345 is the injection of a displacement fluid. Preferably, the displacement fluid is a hydrate inhibitor such as methanol. However, the displacement fluid may also comprise dead crude or diesel. This step is illustrated in Box 230 of FIG. 2A. The purpose of the step of Box 230 is to urge the pig 345 to move through the flowline 342 connecting the water injection manifold 324 and the production manifold 314. From there, the pig 345 is urged by fluid pressure through the production flowline 315 in accordance with later step 240.

Figure 7:
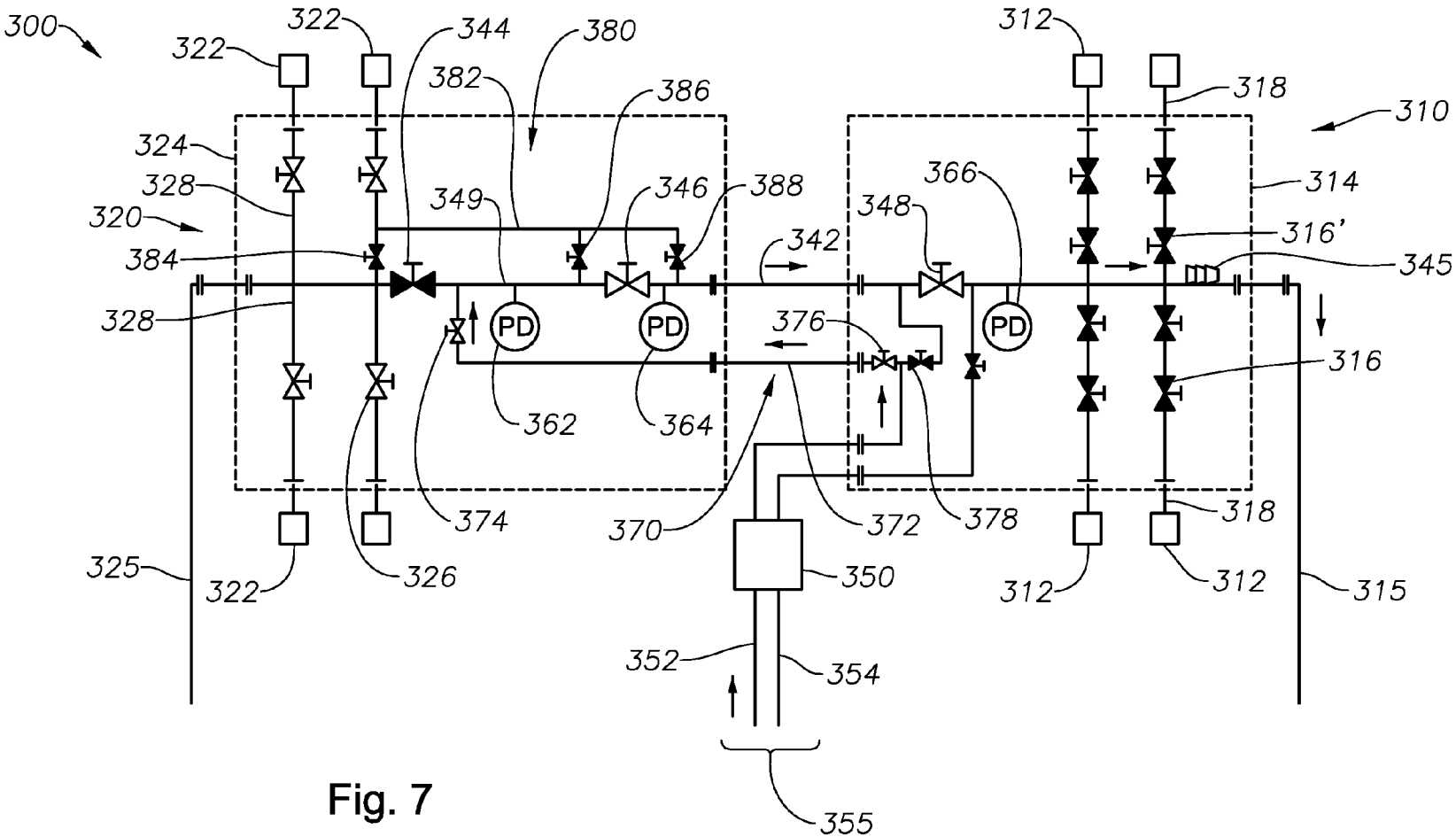
FIG. 7 is another plan view of the production system of FIG. 3. Here, a first pig is being launched from a subsea storage location. A hydrate inhibitor is pumped into the water injection line behind the pig. This serves to displace live crude from the connecting line and production manifold ahead of the pig.

FIG. 7 is another plan view of the production system of FIG. 3. The subsea production system 300 is again seen. FIG. 7 demonstrates implementation of steps 225 and 230. Here, the pig 345 is being launched from the subsea storage location 349. In order to move the pig 345, a hydrate inhibitor is pumped through the chemical injection line 352 of the control umbilical 355. The first 374 and second 376 valves of the crossover displacement system 370 are opened. At the same time, the third valve 378 is closed. This forces the hydrate inhibitor to move through the subsea storage location 349 behind the pig 345. During this time, the production valves 316 and 316' remain closed in order to shut in the producers 312.

Methanol (or other suitable hydrate inhibitor) can then push the pig 345 through the crossover manifold 340 (shown in FIG. 4). The methanol acts as a displacement fluid to displace live crude from the flowline 342 and the production manifold 314. In the view of FIG. 7, the pig 345 is at the production manifold 314. However, as will be shown in FIG. 8, the pig 345 will be urged under fluid pressure past the production manifold 314 and up the production flowline 315.

In one aspect, two pigs may be used. The first pig would be pig 345 seen in FIG. 4. This pig 345 would be a production flowline pig. The production facility 330 may have a pig receiver that incorporates a basket that retains a smaller-diameter pig (not seen). The smaller-diameter pig may be used for scraping solids in the service line 354. The smaller pig is launched from the production facility 330 through the service line 354. In either aspect, pigging capability not only displaces live crude, but may also provide for wax and solids management.

The method 200 next includes the step of isolating the pig storage area 349. This step is illustrated in Box 235 of FIG. 2A. Isolating the pig storage area 349 allows displacement fluid to act against the pig 345 as it moves upward through the water column and to the host production facility 330. It also allows a dead crude to be used as the displacement fluid without worrying about the formation of hydrates in the pig storage area 349.

Related to this step 235, the method 200 also includes the step of displacing water and production fluids by pumping a displacement fluid behind the pig 345 (and behind the hydrate inhibitor). This step is illustrated in Box 240 of FIG. 2A. The purpose of step 240 is to urge the pig 345 to move through the production flowline 315 under fluid pressure. This, in turn, serves to displace water and production fluids from the production flowline 315 and to the host production facility 330.

Figure 8:
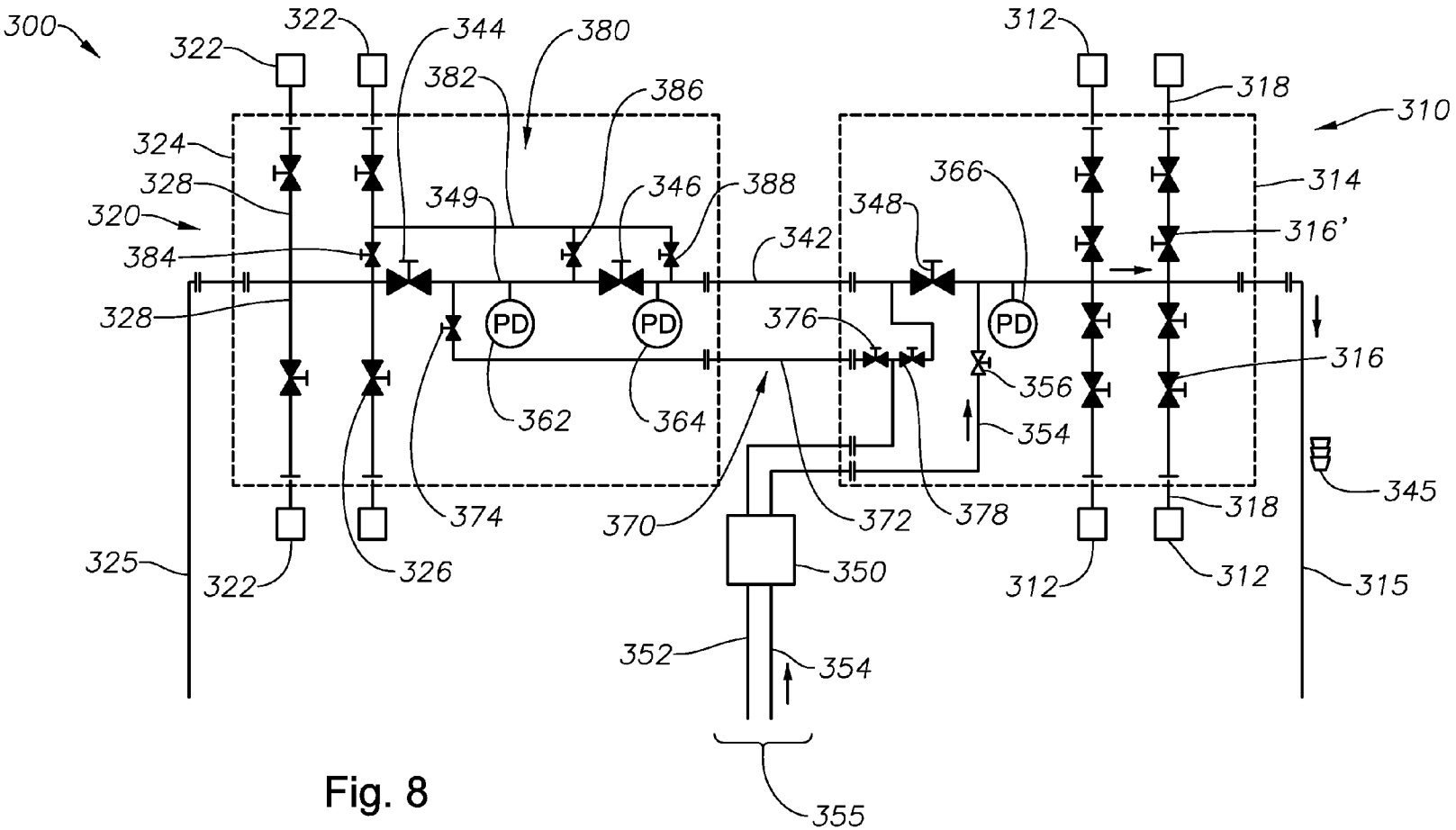
FIG. 8 is another plan view of the production system of FIG. 3. Here, the subsea pig storage location is isolated. Live crude and other production fluids in the production line are displaced by pumping a displacement fluid behind the first pig.

The implementation of steps 235 and 240 are shown together in FIG. 8. FIG. 8 is another plan view of the production system 300 of FIG. 3. The subsea production system 300 is again seen. Here, the pig storage location 349 is re-isolated. This is done by closing the master water injection manifold valve 344 and the crossover manifold valve 346. In addition, the first 374, second 376 and third 378 valves of the crossover displacement system 370 are closed. A displacement fluid is then pumped through service line 354 behind the pig 345. The pig 345 can be seen moving now through the production flowline 315. A fluid control valve 356 is opened to permit the flow of displacement fluid behind the pig 345.

The displacement fluid may be an additional quantity of methanol pumped through displacement fluid service line 354 of the control umbilical 355. However, it is preferred from a cost standpoint that the displacement fluid be dead crude pumped through the displacement fluid service line 354 of the control umbilical 355. In this instance, the third valve 378 of the crossover displacement system 370 and the master production manifold valve 348 are each closed. In either instance, the pig 345 is pushed to a receiver (not shown) at the host production facility 330 so that all live crude and other production fluids in the riser 315 are pushed ahead of the pig 345.

Displacement is accomplished with dead crude or diesel to prevent hydrate formation. The pig 345, with a methanol slug, is pumped ahead of the dead crude to improve the displacement efficiency and to reduce both chemical requirements and displacement time. The production system 300 is preferably capable of flowing the displacement pig 345 at a velocity of at least 0.3 m/s (1 ft/sec). Further, the production system 300 is preferably designed to accommodate the operating pressures which occur when driving the pig 345 with dead crude through the displacement line 354.

The method 200 next includes the step of displacing the displacement fluid (the dead crude) from the production system 300. More specifically, the dead crude is displaced from production manifold 314 and the production flowline 315. This step is illustrated in Box 245 of FIG. 2B.

Figure 9:
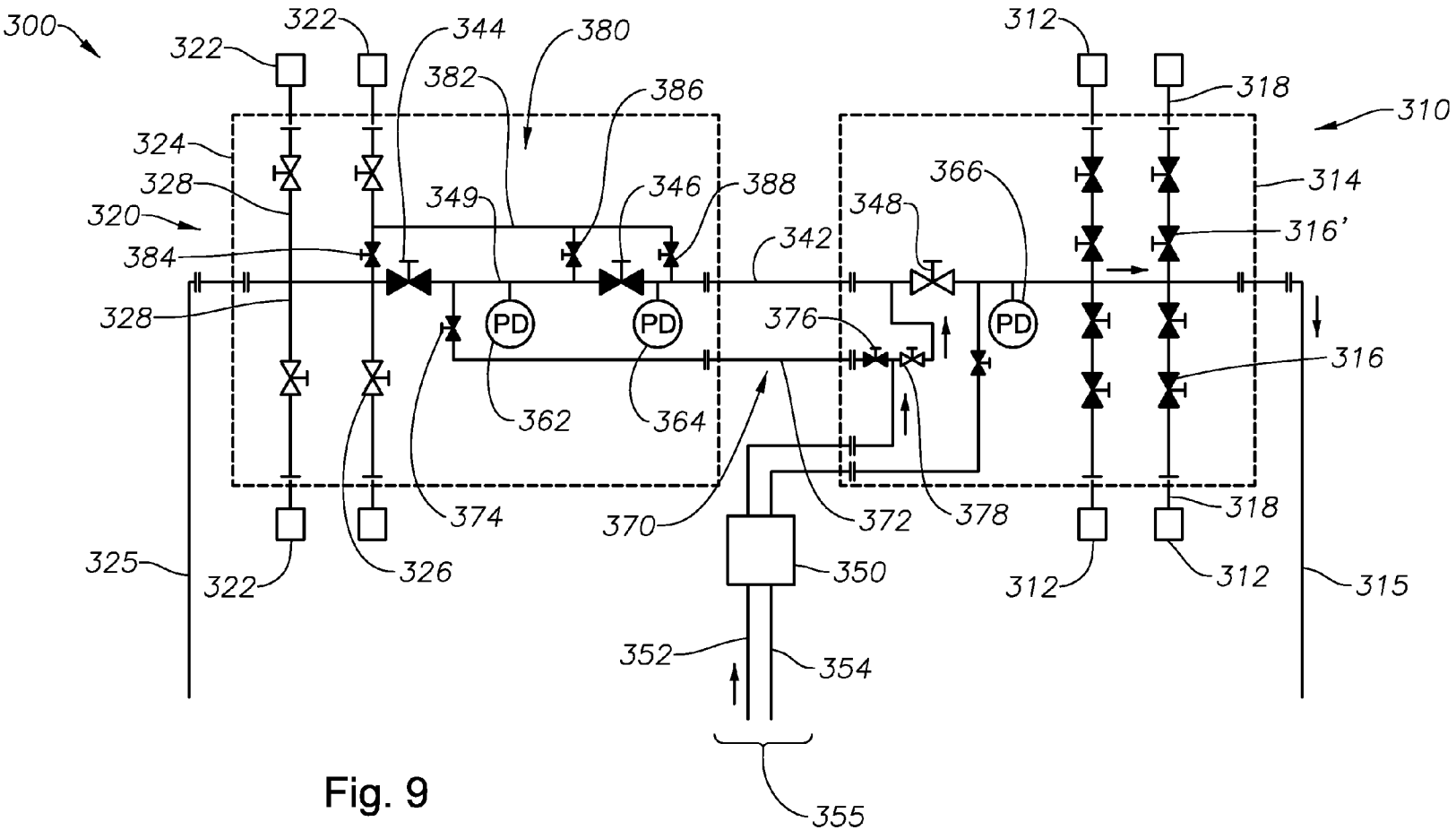
FIG. 9 is another plan view of the production system of FIG. 3. Here, the displacement fluid is being displaced from the production manifold using methanol or other hydrate inhibitor. The production system is now ready to be placed back on line.

FIG. 9 is another plan view of the production system of FIG. 3. The subsea production system 300 is again seen. FIG. 9 demonstrates the implementation of step 245 of FIG. 2B. Here, the dead crude is displaced from the production manifold 314 using methanol or other hydrate inhibitor. The hydrate inhibitor is being injected through the chemical injection service line (or methanol line) 352.

In order to inject methanol (or other inhibitor), the first 374 and second 376 valves of the crossover displacement system 370 remain closed, but the third valve 378 is opened. Also, the master production manifold valve 348 is now opened. Methanol (or other hydrate inhibitor) is urged under pressure through the production manifold 314 and the production flowline 315. Methanol injection will continue during production re-start until the production flowline 315 reaches a minimum safe operating temperature, that is, a temperature that is above the hydrate formation temperature.

In connection with the injection of a displacement fluid, consideration should be given to the tieback distance to the FPSO (or other host facility) 330. The maximum tieback distance for the production system 300 is generally governed by the following parameters:

- the internal diameter of the production flowline 315;
- the internal diameter of the displacement fluid service line 354;
- the maximum allowable operating pressure for the displacement fluid service line 354;
- the time available for displacement of the production flowline 315;
- properties of the selected displacement fluid (dead crude);
- the depth of the operation; and
- the temperature of the ocean water at the seabed.

For a given displacement time, the maximum tieback distance is governed by the displacement flow rate that can be developed through the displacement fluid service line 354 and the production flowline 315. The maximum displacement flow rate, in turn, is governed by the maximum allowable operating pressure ("MAOP") in the integrated umbilical 355. The highest operating pressure in the control umbilical 355 is expected to occur near the touch-down point of the umbilical 355, that is, the point at which the line touches the seabed. The maximum pressure in the displacement fluid service line 354 during displacement operations should not exceed the line's MAOP. Subject to this requirement, the displacement flow rate should be maximized to reduce the displacement time required, and to achieve an adequate pig 345 velocity during displacement.

Those of ordinary skill in the art of subsea architecture will understand that the smaller the diameter of a flow line, the higher the pressure drop that will be experienced in that line. Similarly, the longer the length of a flow line, the higher the pressure drop that will be experienced across that line.

Preliminary steady-state hydraulics were calculated using PipePhase™ software to determine the maximum tieback distance, as governed by a 12-hour displacement time and maximum allowable operating pressure in a service line (due to friction loss and flow rate). The following table lists the maximum tieback distance for three flow line sizes and three corresponding service line sizes, as follows:

| Production Flowline Nominal Diameter (inches) | Fluid Displacement Service Line (inches) | Maximum Tieback Distance (km) |
|---|---|---|
| 8 | 3.0 | 14.5 |
| 10 | 3.0 | 10.0 |
| 12 | 3.0 | 7.5 |
| 8 | 3.5 | 16.0 |
| 10 | 3.5 | 12.2 |
| 12 | 3.5 | 9.0 |
| 8 | 4.0 | 18.0 |
| 10 | 4.0 | 13.0 |
| 12 | 4.0 | 10.0 |

It can be seen that a larger service line diameter accommodates a longer tieback distance.

An analysis was also conducted as to the maximum displacement or pumping rate that might be used to displace fluids from a production line 315/335*p*/332. The study assumed that production operations were taking place in 1,500 meters of water depth, and that hydrocarbon fluids were being displaced with a 30° API dead crude (45 cp at 40° F.). The arrival pressure of the displacement fluid at the FPSO was assumed to be 350 psig.

For a 3-inch displacement fluid service line 354 at a 6 km tieback distance, the maximum pumping rate is about 9,000 bbl/day.

In a 3-inch displacement fluid service line 354 at an 8 km tieback distance, the maximum pumping rate is about 8,000 bbl/day.

In a 3-inch displacement fluid service line 354 at a 10 km tieback distance, the maximum pumping rate was about 7,000 bbl/day.

In a 3-inch displacement fluid service line 354 at a 12 km tieback distance, the maximum pumping rate was about 6,500 bbl/day.

In a 3-inch displacement fluid service line 354 at a 14 km tieback distance, the maximum pumping rate was about 6,000 bbl/day.

In a 3-inch displacement fluid service line 354 at a 16 km tieback distance, the maximum pumping rate was about 5,500 bbl/day.

For a 4-inch displacement fluid service line 354 at a 6 km tieback distance, the maximum pumping rate was about 13,500 bbl/day.

In a 4-inch displacement fluid service line 354 at an 8 km tieback distance, the maximum pumping rate was about 12,000 bbl/day.

In a 4-inch displacement fluid service line 354 at a 10 km tieback distance, the maximum pumping rate was about 10,100 bbl/day.

In a 4-inch displacement fluid service line 354 at a 12 km tieback distance, the maximum pumping rate was about 9,000 bbl/day.

In a 4-inch displacement fluid service line 354 at a 14 km tieback distance, the maximum pumping rate was about 8,000 bbl/day.

In a 4-inch displacement fluid service line 354 at a 16 km tieback distance, the maximum pumping rate was about 7,500 bbl/day.

It is also noted that the friction loss in the service line and the resulting maximum tieback distance are affected by the viscosity of the displacement crude. The maximum pumping rates described above may be increased by adding a drag-reducing agent to the dead crude. Alternatively, or in addition, the viscosity of the displacement fluid may be lowered.

After the dead crude has been displaced from the production manifold 314, procedures are commenced for placing the production system 300 back on line. Optionally, before the system 300 goes back into production, a new pig 345' may be placed into the subsea storage location 349. Thus, the method 200 may next include the step of launching a replacement pig 345' into the water injection line 325. This step is illustrated in Box 250 of FIG. 2B. However, it is not required to replace the pig before restarting production.

Figure 10:
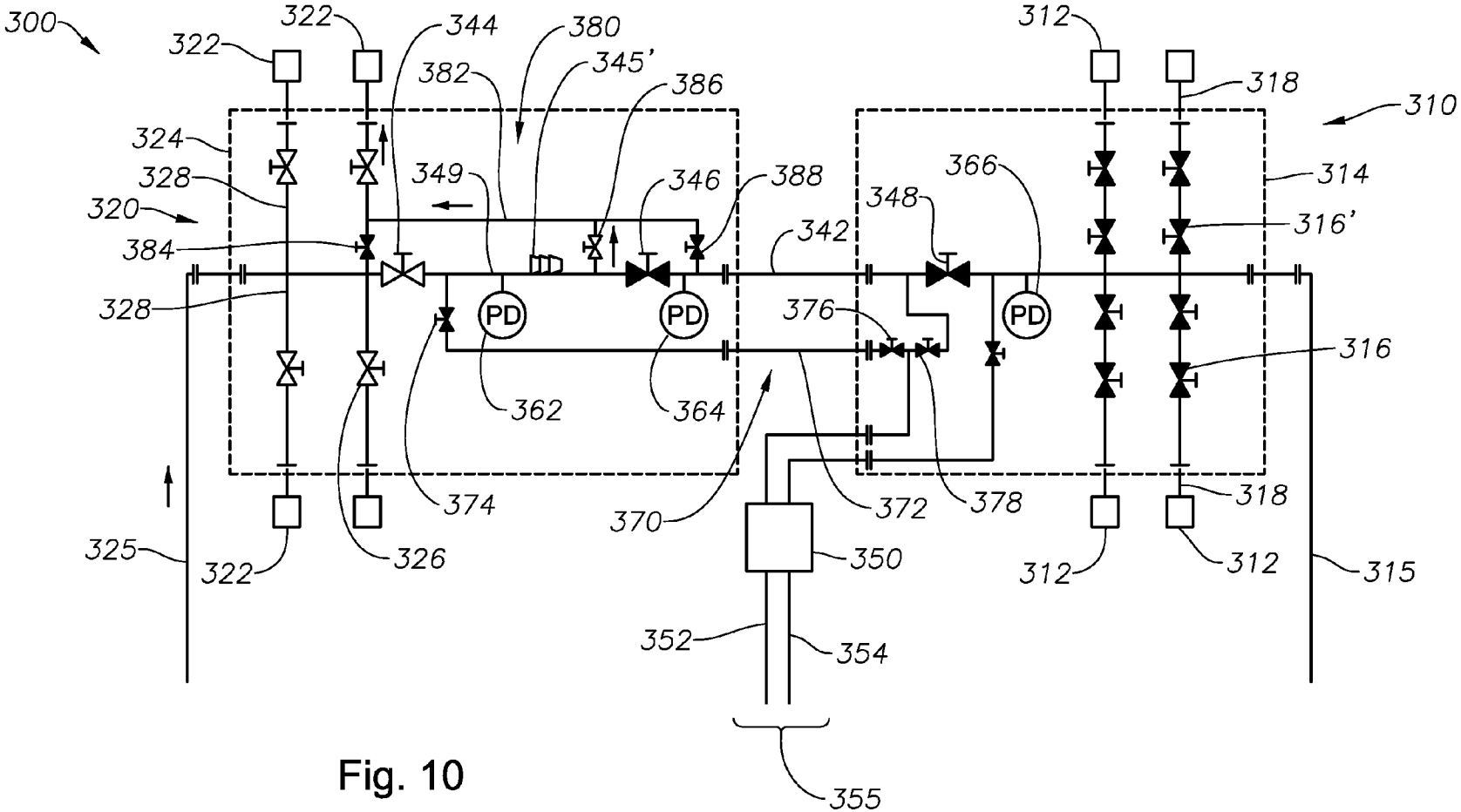
FIG. 10 is another plan view of the production system of FIG. 3. Here, a replacement pig is being launched into the water injection line, and pushed to the subsea storage location using injection water. A pig detector detects when the pig is parked.

FIG. 10 is another plan view of the subsea portion of the production system of FIG. 3. Here, a new pig 345' has been launched into the water injection line 325. Further, the pig 345' has been pushed to the subsea storage location 349 in or near the water injection manifold 324 using injection water. The first pig detector 362 detects when the new pig 345' is parked.

In order to land the new pig 345' in the subsea storage location 349, the master water injection manifold valve 344 is opened. In addition, the water injection valves 326 are opened. However, the first 384, second 386, and third 388 water injection return valves are closed.

Once the replacement pig 345' is landed in the subsea storage location 349, the pig 345' is secured. This step of the method 200 is indicated at Box 255 of FIG. 2B. In order to secure the pig 345', both the master water injection manifold valve 344 and the crossover manifold valve 346 are closed. Further, the second 386 water injection return valve is closed. The first valve 384 may be opened.

After the new pig 345' is secured, the subsea production system 300 is ready to be placed back on line. The step of putting the production wells 312 back on line is indicated at Box 260 of FIG. 2B. The step of injecting water into the water injection wells 322 is indicated at Box 265 of FIG. 2B.

It is noted that the method 200 does not require that water injection must be completely shut down. If a top-side water injection system is available, water injection may continue through the entire process as it does not directly affect the production line 335*p*. There would typically be some reduction in water flowrate while delivering the replacement pig 345'.

Figure 11:
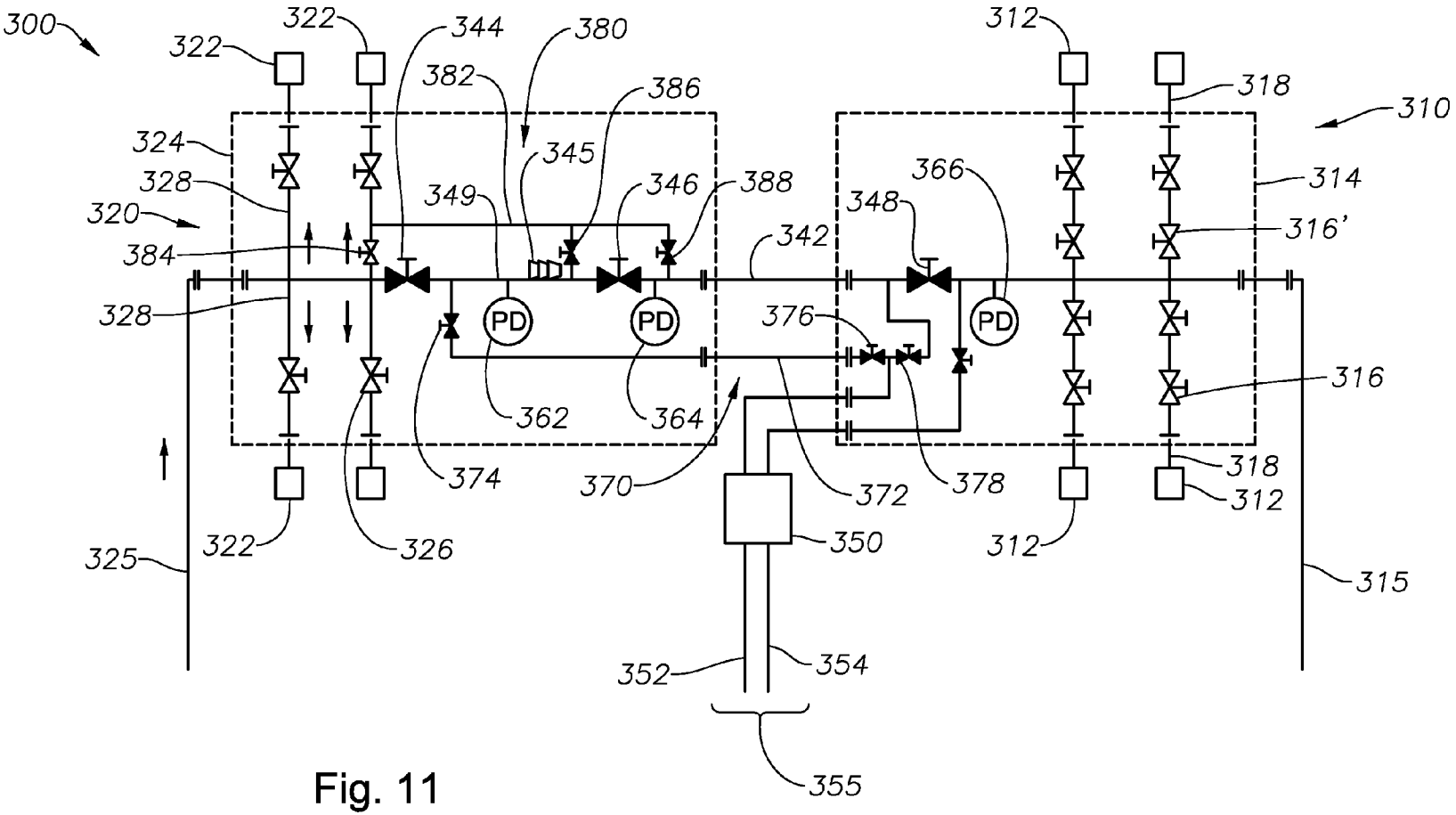
FIG. 11 is another plan view of the production system of FIG. 3. Here, the pig is secured in the subsea storage location. Production wells in the production cluster have been placed back on line. A hydrate inhibitor is preferably mixed with the production fluids until the production line and riser have reached a minimum safe operating temperature.

The steps of Box 255 and Box 260 are illustrated together in FIG. 11. FIG. 11 is another plan view of the production system 300 of FIG. 3. As can be seen in FIG. 11, water is now being injected through the water injection line 325. Further, water is now flowing through the injection jumpers 328 and to the injection wells 322. The injection valves 326 have been opened to permit the flow of injection water.

It is also noted that the water injection return system 380 has been closed. In this respect, water is no longer flowing through the return line 382. While the first 384 water injection return system valve is open, the second 386 and third 388 water injection return system valves are closed.

The crossover displacement system 370 is also closed to fluid flow. In this respect, the first 374, second 376 and third 378 bypass valves are closed. Preferably, hydrate inhibitor for production-well re-start operations will be provided through other inhibitor lines in the umbilical (not shown). In any event, master production manifold valve 348 should be closed so that produced fluids will not enter central pipeline 342.

It can also be seen in FIG. 11 that the production wells 312 have been placed back on line. The production valves 316 closest to the wells 312 have been opened to permit the outbound flow of production fluids into the jumpers 318. Similarly, the production valves 316' closest to the manifold 314 are now opened for production. In the view of the subsea production system 300 of FIG. 11, it is understood that methanol or other hydrate inhibitor may be injected into the production manifold 314 as the producers 312 are first brought into production.

As production continues, the operator may choose to continue injecting water through the water injector line 325. The purpose may be to simply dispose of water into a subsurface formation. Alternatively, water may be injected in order to maintain reservoir pressure or provide sweep efficiency. The step of continuing to inject water through the water injection line 325 is illustrated at Box 265 of FIG. 2B.

A final step in the method 200 for managing hydrates is to again produce production fluids to the host production facility 330. This step is illustrated in Box 270 of FIG. 2B.

Figure 12:
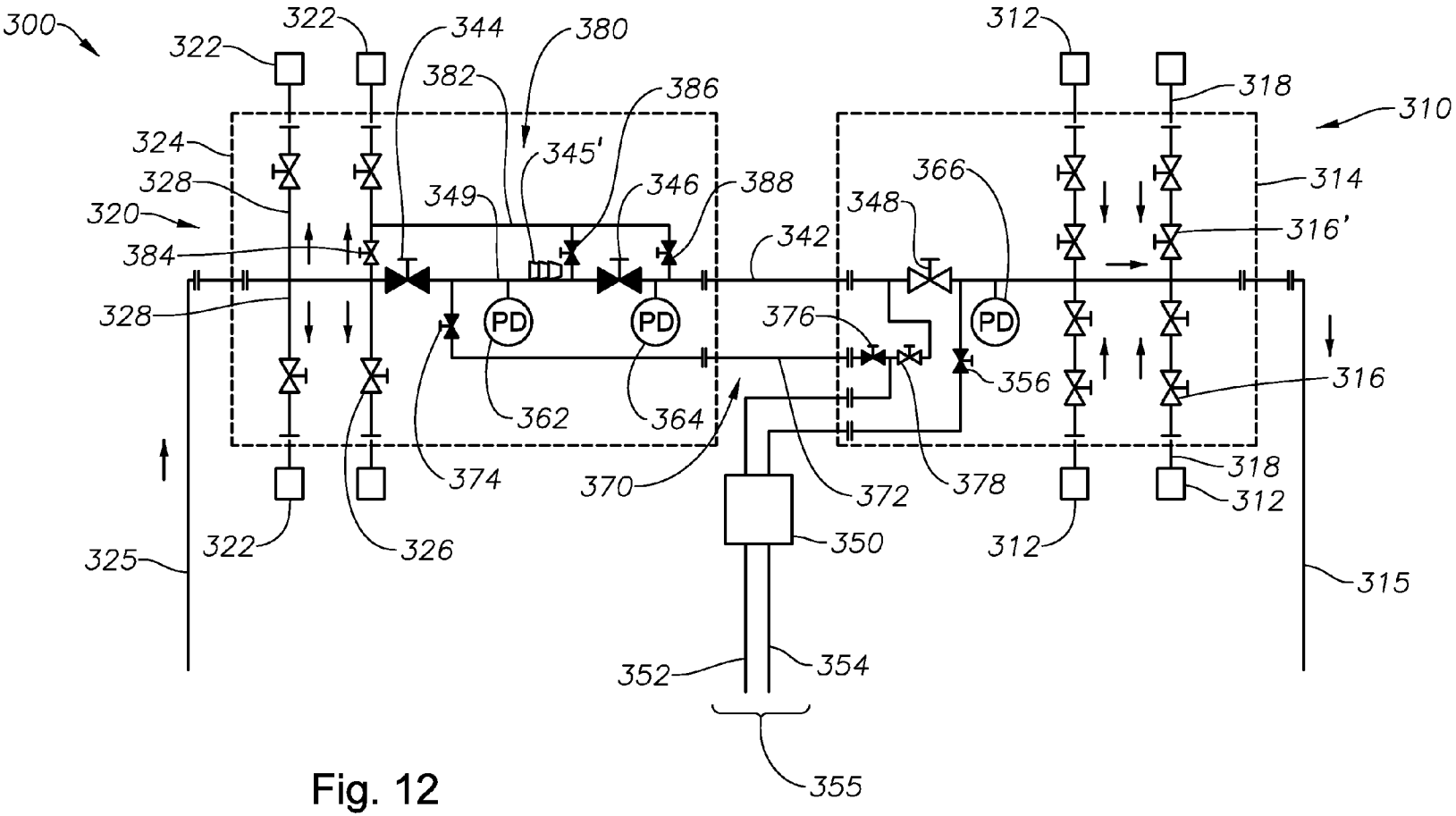
FIG. 12 is another plan view of the production system of FIG. 3. The production wells remain on line, and water injection continues. Production is established.

FIG. 12 is another plan view of the production system of FIG. 3. Here, it can be seen that the production valves 316, 316' have been opened. Production fluids are able to flow through the production jumpers 318, through the production manifold 314, and into the production flowline 315. From there, production fluids flow through the production riser 335*p* and the flexible production hose 332, and to the production facility 330.

A hydrate inhibitor is preferably mixed with the production fluids until the jumpers 318 and the production flowline 315 have reached a steady state operating temperature. The third bypass valve 378 and the master production manifold valve 348 are temporarily opened to deliver hydrate inhibitor from the chemical service line 352. In one aspect, the subsea production system 300 is designed such that the produced fluids never enter into the hydrate formation region during steady state conditions at the defined minimum flowrates for the wells and flowlines. In one aspect, the time available for the single production flowline displacement is 12 hours, based on a 20-hour cool-down time having 8 hours combined no-touch and initial hydrate inhibitor application (light touch).

It is preferred that the time duration for start-up procedures be of sufficiently short duration to minimize any paraffin or "wax" deposition that may take place. Wax deposition is preferably managed by maintaining temperatures throughout the production stream above the wax appearance temperature (WAT).

It is also preferred that the subsea production system 300 be maintained with intermittent pigging. Regular maintenance pigging helps to ensure that the displacement pig 345' will not become lodged during later displacement operations. The displacement pig 345 may be periodically run through the production flowline 315 for the purpose of maintaining flow assurance in the production flowline.

Various other features may be incorporated into the subsea production system 300. For instance, coiled tubing access may be provided from the production facility 330 to remediate hydrates, wax, asphaltenes, scale, sand, and other solids in the production flowline 315. Also, the production flowline 315 may be designed to permit depressurizing and chemical injection from a mobile offshore drilling unit ("MODU") at a connection at the production manifold 314. Further still, a subsea pig launcher may be used in lieu of a crossover manifold.

In addition to the specific steps identified above for the hydrate management method 200, steps may optionally be taken to manage wax buildup in the fluid-displacement service line 354. Wax deposition in the umbilical dead oil service line 354 should be managed to prevent blockage or significant reduction in the service line 354 flow capacity over the life of the field. Wax management steps may be a combination of (1) pigging of the service line 354 to remove wax; (2) use of a wax inhibitor to minimize wax deposition in the service line 354; and (3) use of a chemical solvent to remove wax from the service line 354.

The priority and combination of wax management approaches may be selected based on the wax deposition properties of the specific dead crude blends anticipated during the service life of the subsea production system 300. The number of anticipated displacement events and the wax deposition rate will dictate the cumulative wax deposition buildup, which in turn will guide the required pigging frequency and the opportunity for using wax inhibitors or solvents in lieu of or in addition to pigging.

It is noted that in most if not all subsea production operations the displacement fluid service line 354 within the umbilical 355 has a much smaller inner diameter than the subsea production flowline 315. For example, the inventors believe that the maximum ID for service lines currently in use for some subsea oil and gas operations is approximately 3 inches.

A 3-inch ID integrated service line does not have sufficient capacity to provide the needed velocity for pipeline fluid displacement within the available cool-down time to hydrate formation conditions. In this respect, the friction loss in a 3-inch (or less) ID service line imposes a constraint on the displacement flow rate. Specifically, the flow rate in the field using a 10-inch insulated pipe-in-pipe subsea production flowline and production riser may not exceed 0.3 meters per second (0.98 feet/second). For a body of water that is below about 4.44° C. (40° F.) such that hydrate formation is a concern, this places an effective limit on the tieback distance of about 10 km (6.2 miles). Similarly, a system using a 3½ inch ID integrated service line with an 8-inch subsea production flowline has an effective limit of about 16 km (9.9 miles).

It is desirable to provide a tieback (subsea production flowline plus production riser) length that is at least 10 km (6.2 miles). Indeed, it is desirable to have a tieback distance that is up to 30 km (18.6 miles) or even up to 60 km (37.2 miles) in length. To avoid hydrate formation during the long cool down time for a single tieback that is greater than 10 km in length, two options are proposed herein:

(1) increase the diameter of the displacement fluid service line 354; and (2) artificially increase the temperature of at least a portion of the production jumper (or subsea flow line) and production riser.

Concerning the first proposal, increasing the diameter of the displacement fluid service line is may not be an option for some operations. As noted above, the maximum ID for service lines currently in use by some operators for subsea operations is believed to be 3 inches. However, it is desirable to employ a 4- to 6-inch diameter external displacement fluid service line.

Concerning the second proposition, it is desirable to artificially increase the temperature of at least a portion of the production flowline. This may be done by applying electrical heating along a selected portion of the production flowline 325 and the production riser 335*p*.

Figure 13:
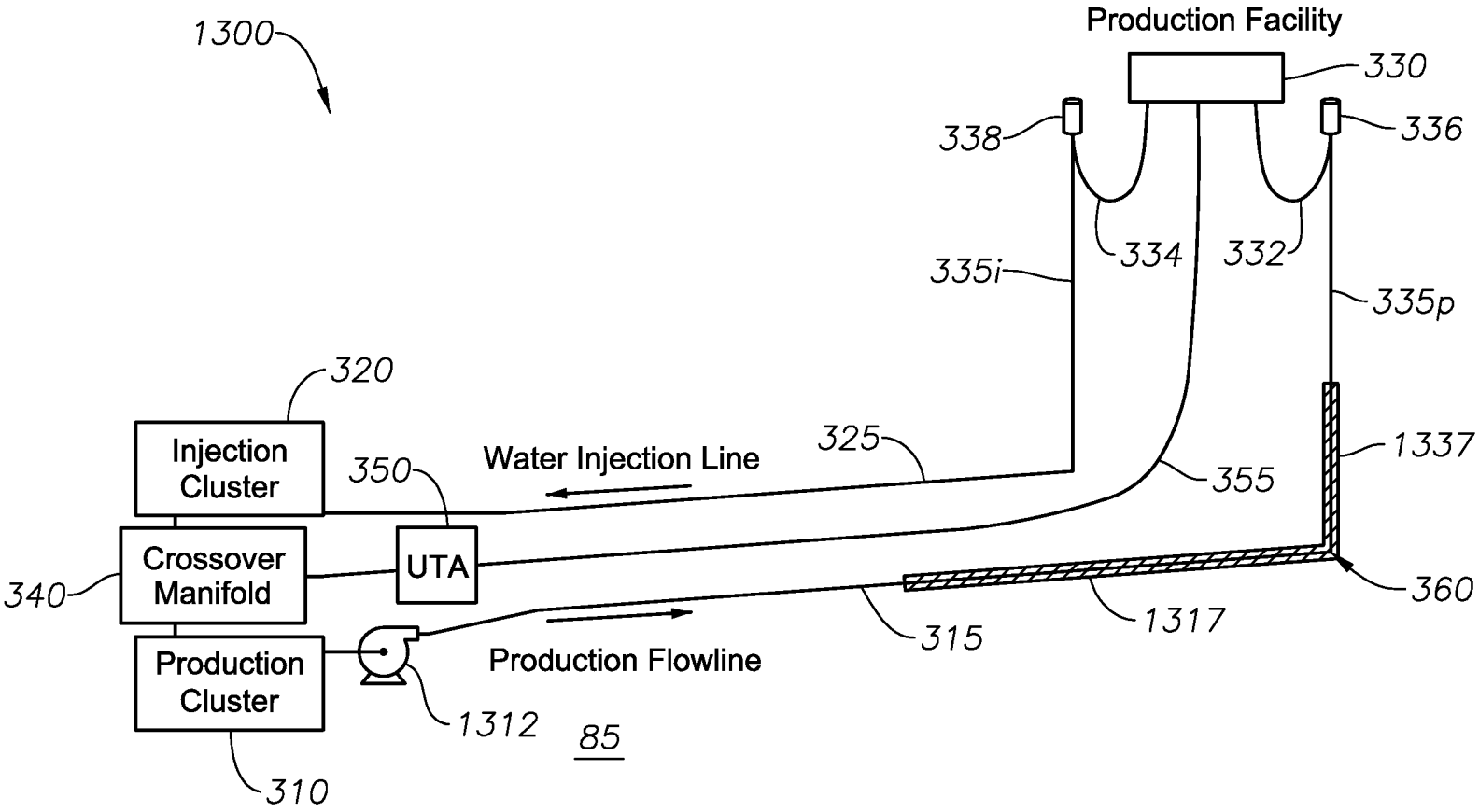
FIG. 13 is a side view of the production line, the water injection line and the utility umbilical line from the subsea production system of FIG. 3. The view is generally schematic, and shows the subsea production system in production. Here, a portion of the production line is being heated.

FIG. 13 presents a side view of a subsea production system 1300. The production system 1300 is generally in accordance with subsea production system 300 of FIG. 3. In this respect, the production system 1300 includes a production cluster 310 and an injection cluster 320. The production cluster 310 generally comprises one or more production wells (or "producers"), and a production manifold. Similarly, the injection cluster 320 generally includes one or more subsea injection wells (or "injectors"), and an injection manifold. The production cluster 310 and the injection cluster 320 are illustrated in greater detail in FIG. 4, discussed above.

The subsea production system 1300 also includes a production facility 330. Typically, the production facility 330 will be either (1) a ship-shaped floating production, storage and offloading vessel (or "FPSO"), (2) a semi-submersible vessel, (3) a tension-leg platform vessel, or (4) a deep-draft caisson vessel. However, the present methods are not limited by the nature or configuration of the host production facility 330.

The production cluster 310 is placed in fluid communication with the production facility 330 by a production line. The production line generally comprises a production flowline 315 along the marine floor, and a production riser 335*p*. Similarly, the injection cluster 320 is placed in fluid communication with the production facility 330 by means of a water injection line. The water injection line generally comprises an injection flowline 325 along the marine floor, and a water injection riser 335*i*.

The production flowline 315 is preferably insulated. More specifically, the production flowline 315 is preferably a rigid steel pipe-in-pipe insulated flowline. It is also preferred that the various jumpers and trees used in the subsea production cluster 310 be insulated. The insulation is designed such that the produced fluids do not enter a hydrate formation phase during steady state conditions at the anticipated minimum flow rates for the produced fluids. However, the water injection flowline 325 is preferably a rigid steel uninsulated flowline.

For the production riser 335*p*, the connection to the production facility 330 may include a length of flexible top-side hose 332. Similarly, for the injection line 335*i*, the connection to the production facility 330 may include a length of flexible top-side hose 334. Also, the production system 1300 preferably includes a "crossover manifold" 340, as described above in connection with FIGS. 3 and 4.

The subsea production system 300 also may include an umbilical 355 and an umbilical termination assembly 350. The umbilical termination assembly ("UTA") 350 is preferably landed on the ocean bottom proximate the crossover manifold 340. The umbilical 355 is connected at an upper end to the host production facility 330, and at a lower end to the UTA 350.

In the subsea production system 1300, a portion of the production line is being heated. Specifically, a portion 1317 of the production flowline 315 is heated, and a portion 1337 of the production riser 335 is heated. These heated portions 1317, 1337 are indicated schematically by cross-hatching. Heating takes place preferably after the producers have been shut in as a cool down period begins.

Heating is provided through electric heating. In one aspect, heating elements are placed along the production flowline 315 and the production riser 335. The heating elements may be resistive heating elements such as conductive coils, with current delivered from an electrical source. This offers "indirect" heating. More preferably, current is applied directly through the outer circumference of the flowline. This offers "direct" heating.

In the latter instance, the subsea flow line and the production riser will preferably have a pipe-in-pipe arrangement. A non-conductive insulator is placed in the annular region between the two pipes. A conductive connection is then placed between the pipes at some point along the production flow line, providing electrical communication between the inner fluid-transporting pipe and the outer "carrier" pipe. In this way, the production line serves as an electrical circuit.

It is not necessary to heat the entire length of the production line; rather, only a selected portion 1317, 1337 of the production flowline 315 and the production riser 335 need be fitted for heating. Preferably, a determination is made as to which portion of the single production line may enter a hydrate formation phase after anticipated shut-in periods. The anticipated shut-in period wherein heating would be needed for an extended-length single production line would be at least 15 hours, and more preferably, at least 30 hours.

Various factors may be considered when determining the portion of the single production line that may enter a hydrate formation phase. These include (i) fluid pressure within the subsea production flowline, (ii) production fluid composition; (iii) fluid temperature within the flowline, (iv) seabed incline, (v) internal diameter of the displacement fluid service line, (vi) temperature gradient within the water column, or (vii) combinations thereof.

The system 1300 in FIG. 13 may optionally include a subsea pump 1312. This feature may be needed if the flowline is sufficiently long such that boosting the produced fluids is necessary to achieve the desired flow rates. The subsea pump 1312 is strategically located proximate the production cluster 310. In this way, supplemental pressure may be applied to the subsea flowline 315. This, in turn, further enables an extension of the combined length of the flowline 315 and the production riser 335*p*. In one aspect, the subsea pump 1312 has a power requirement of between 1 and 6 megawatts, depending on the length of the flowline and other design considerations. This is considered a large pump for subsea operations. In one aspect, the subsea pump 1312 is located proximate a lower end of the production riser 335*p*.

Figure 14:
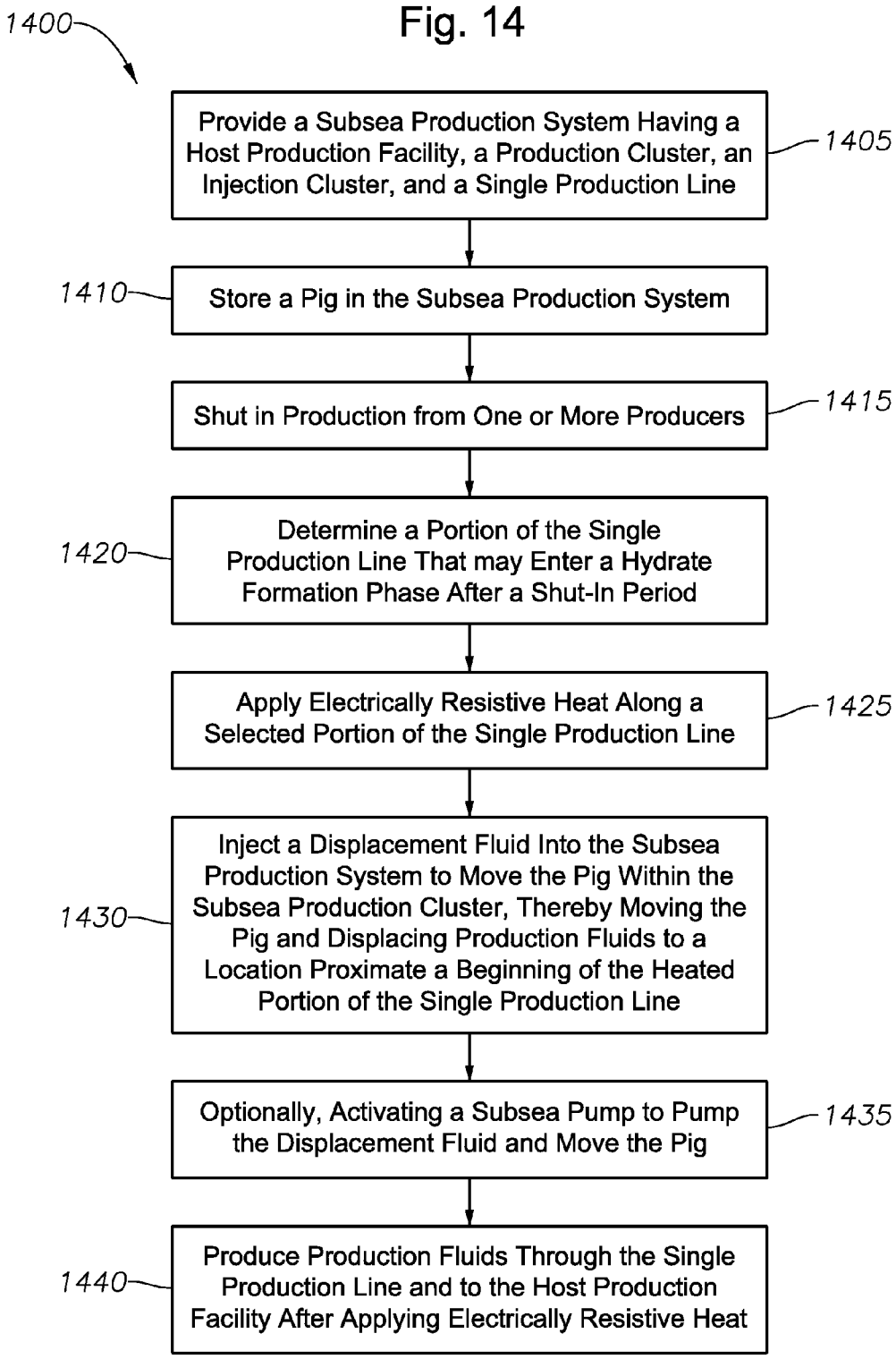
FIG. 14 is a flowchart for a method of managing hydrates in a subsea production system, in one embodiment.

A method is provided herein for managing hydrates in a subsea production system. FIG. 14 presents a flowchart showing steps for such a method 1400. The subsea production system for the method 1400 operates in accordance with the subsea production system 1300 of FIG. 13. In this respect, the subsea production system operates with a host production facility, a production cluster comprising one or more producers, a water injection cluster comprising one or more water injectors, a water injection line, and a single production line.

The single production line preferably comprises a subsea production flowline and a production riser in fluid communication with the host production facility. The production riser preferably comprises an insulated pipe-in-pipe flowline. The production line is preferably at least 10 km (6.2 miles) in length and may be over 30 km (18.4 miles) in length.

The method 1400 first includes providing the subsea production system. This is shown in Box 1405. In the system, the single production line directs fluids from the production cluster to the host production facility.

The method 1400 also includes storing a pig in the subsea production system. This is provided at Box 1410. Storing a pig in the subsea production system may comprise placing the pig into a subsea pig launcher. The pig is launched from the surface and through the water injection line after a period of time. Alternatively, the pig is maintained between two control valves within the water injection cluster, and then launched ahead of a displacement fluid.

The method 1400 also includes shutting in production from the one or more producers. This is seen at Box 1415. Shutting in production is typically done before launching the pig.

The method 1400 also includes applying heat along a selected portion of the single production line. This is provided at Box 1425. In one aspect, the heat is electrically resistive heat generated by flowing a current through a resistive heating element such as a conductive coil. More preferably, heat is applied by flowing electrical current through the body of the pipe making up the production line itself This produces so-called "skin effect" heating.

To provide the heat, an electrical source configured to deliver an electrical current to a portion of the single production line is provided. Heat is applied in order to maintain production fluids within the production line at a temperature above a hydrate formation temperature after production has been shut in.

In providing the flowline heating, the operator may determine what portion of the single production line will enter a hydrate formation phase after a shut-in period. This step is provided at Box 1420. The shut-in period may be, for example, at least 15 hours. This would typically be a period of time that includes depressurization and a light touch operation. The determined portion would be identified as the selected portion of the single production line to be heated in the heating step of Box 1425. The determined portion may correspond to the gas-dominated portion of the subsea flowline and riser upon shut-down.

The method 1400 also includes injecting a displacement fluid into the subsea production system. This is seen at Box 1430. The displacement fluid may be, for example, crude oil, diesel, or a combination thereof. Alternatively or in addition, the displacement fluid may comprise a hydrate inhibitor. The displacement fluid is injected in order to move the pig within the subsea production cluster, thereby at least partially displacing production fluids from the production cluster. Of benefit, the pig is moved to a location along the heated portion of the single production line. This means that the operator need not purge the entire production riser of hydrocarbons. This, in turn, saves time and money for the operator.

The subsea production system may include additional components. For example, the subsea production system preferably also comprises a control umbilical having a hydrate inhibitor line and a displacement fluid service line. In this arrangement, displacement fluid may be injected into the subsea production system through the displacement fluid service line. The displacement fluid service line is preferably sized to move the pig through the subsea production line at a minimum velocity of 0.3 meters/second (1 ft/sec).

In one aspect, the subsea production system further comprises a subsea pump. In this optional instance, the method 1400 then further comprises activating the subsea pump in order to pump the displacement fluid and move the pig. This is provided at Box 1435. It is noted that the step of moving the pig of Box 1435 would occur under shut-in conditions, and would typically involve much lower flow rates than are used with the large subsea pump 1312 of FIG. 13. In addition, the pump used for pumping a displacement fluid and moving a pig in Box 1435 is preferably located along the service line circuit rather than on the production flowline.

The production cluster may include not only the one or more producers, but also a production manifold. Further, the production cluster may include jumpers for providing fluid communication between the production manifold and the one or more producers. The method 1400 may then further comprise producing production fluids through the production manifold, through the single production line, and to the host production facility. This is seen at Box 1440. The production fluids preferably comprise at least 50% vol. liquid phase fluids at the production manifold.

The subsea production system also preferably includes a water injection cluster. The water injection cluster comprises one or more water injectors, and a water injection manifold. In this arrangement, the water injection line may comprise a water injection riser and a subsea flowline for receiving injection water from the host production facility.

The subsea production system may also have a crossover manifold. A central pipeline may be placed in the crossover manifold to provide fluid communication between the water injection cluster and the production cluster. In this arrangement, launching the pig may comprise advancing the pig from the subsea storage location, through the central pipeline, and to the production manifold.

When the producers are shut in, the operator may desire to provide light touch operations before applying heat to the single production line. To do this, the operator pumps a hydrate inhibitor through the hydrate inhibitor line into the production manifold. This is typically done before moving the pig through the production cluster.

The method 1400 may also include further injecting displacement fluid into the subsea production system in order to displace the hydrate inhibitor and pig through the single production line and to the host production facility. Preferably, the displacement fluid is a dead displacement fluid such as crude oil, diesel, or a combination thereof. Alternatively, the displacement fluid may be additional hydrate inhibitor.

In another aspect of the method 1400, storing a pig in the subsea production system of Box 1410 comprises injecting the pig into the water injection line, and then advancing the pig into a subsea storage location in the subsea production system using injection water. Alternatively, storing a pig in the subsea production system comprises placing the pig into the water injection cluster using a subsea pig launcher. In either instance, the method may further include storing the pig in the subsea storage location for a period of time, and launching the pig from the subsea storage location. Launching the pig may comprise advancing the pig from the subsea storage location, through the central pipeline, and to the production manifold.

After the pig has been launched from the subsea storage location, a new pig may be placed in the subsea storage location. Thus, in one aspect, the method 1400 further comprises launching a new pig from the host production facility. From there, the pig is moved through the water injection riser, through the water injection flowline, and to the subsea storage location. The pig is stored in the subsea storage location until a later time. The producers may be put back into production either before, during, or after the new pig is moved to the subsea storage location. Upon production, hydrocarbon fluids are produced from the one or more producers, through the production manifold, through the production flowline, through the production riser, and to the host production facility. The step of producing hydrocarbons is again shown at Box 1440.

During a production line displacement procedure, it is optional to continue to inject water through the one or more injectors. In one aspect, water continues to be injected through the one or more injectors even while the pig is being moved to the subsea production cluster.

In one aspect of the method 1400, the subsea production system further comprises a stand-alone manifold located near an outer end of the production flowline. This is in lieu of placing a crossover manifold between the injection manifold and the production manifold. The water injection line and the stand-alone manifold are interconnected by an extension of the water injection flowline and a smaller-bore water return line.

Figure 15A:
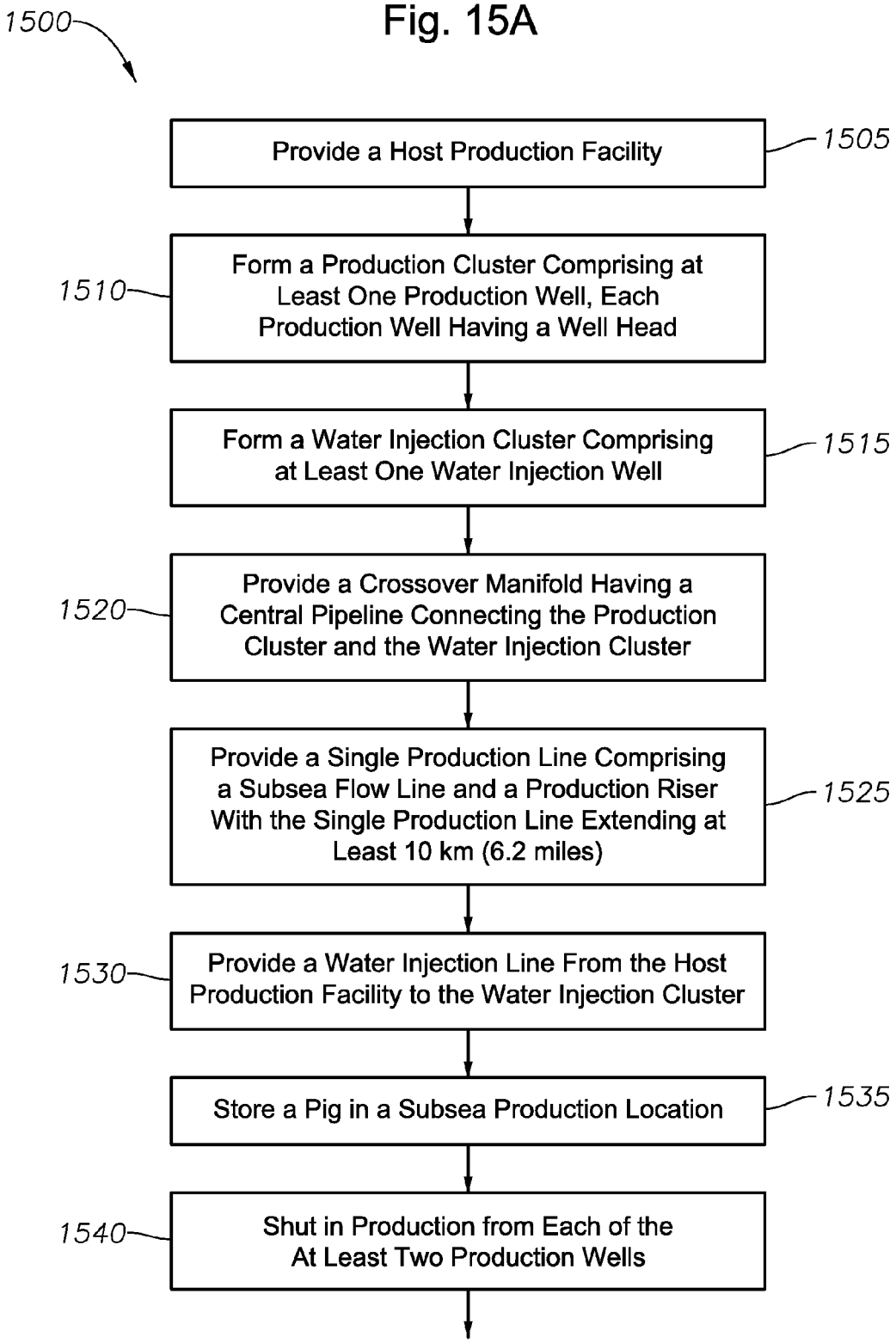
FIGS. 15A and 15B present a single flowchart for a method of constructing a subsea production system, in one embodiment.
Figure 15B:
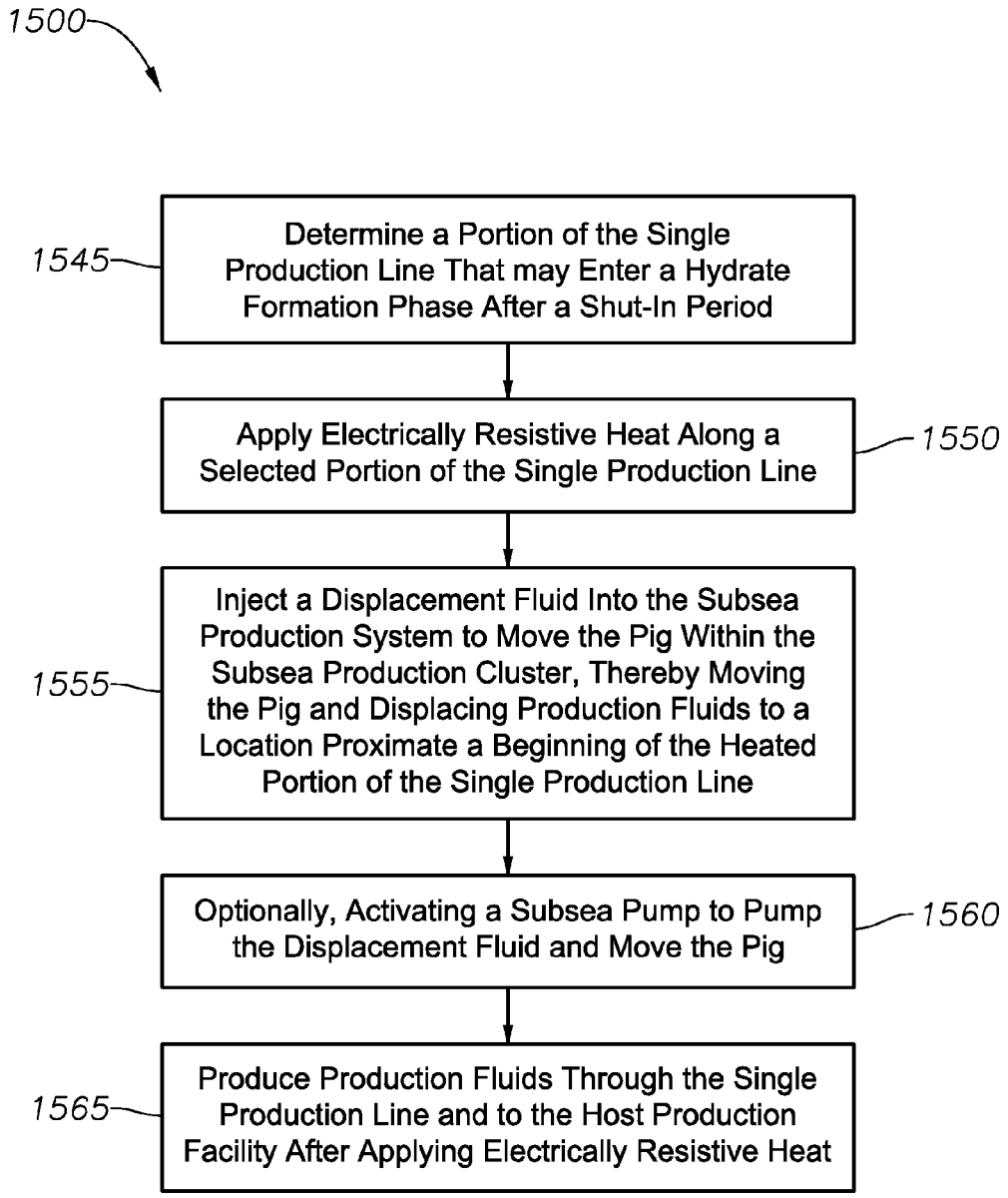

A method of constructing a subsea production system is also disclosed herein. FIGS. 15A and 15B present a unified flowchart for a method 1500 of constructing a subsea production system. The production system is located in a marine body, with the marine body having a water surface and a seabed depth of at least 500 meters (1,640.4 feet) below the water surface. The location further has a seabed temperature below 5° C. (41° F.).

In one embodiment, the method 1500 comprises providing a host production facility. This is shown at Box 1505. The host production facility may be in accordance with facility 70 shown in FIG. 1, or other surface facility as described above.

The method 1500 also includes forming a production cluster. This is seen at Box 1510. The production cluster may be in accordance with production cluster 310 shown in FIGS. 4 through 12, or as otherwise described above. The production cluster has at least one production well, with each production well having a wellhead on the seabed or otherwise within the marine body.

The method 1500 further includes forming a water injection cluster. This is provided at Box 1515. The water injection cluster has at least one water injection well. The water injection cluster may be in accordance with water injection cluster 320 shown in FIGS. 4 through 12, or as otherwise described above.

The method 1500 also includes providing a crossover manifold. This is seen at Box 1520. The crossover manifold has a central pipeline connecting the production cluster and the water injection cluster. The crossover manifold may be in accordance with manifold 340 shown in FIGS. 4 through 12, or as otherwise described above.

The method 1500 further comprises the step of providing a single production line. This is shown at Box 1525. The single production line comprises a subsea flow line and a production riser. The subsea flow line and production riser may be in accordance with lines 315/335*p* shown in FIG. 13, or as otherwise described above. The single production line preferably extends at least about 30 km (18.6 miles) from the production cluster to the host production facility.

The method 1500 also includes providing a water injection line. This is indicated at Box 1530. The water injection line may be in accordance with water injection line 325/335*i* shown in FIG. 13, or as otherwise described above. The water injection line generally extends from the host product facility to the water injection cluster.

The method 1500 also includes storing a pig. This is seen at Box 1535 of FIG. 15A. The pig is stored in a subsea storage location. The subsea storage location may be in accordance with storage location 349 of FIGS. 4 through 12, or as otherwise described above. The subsea storage location may be, for example, in a water injection manifold in the water injection cluster.

The method 1500 also comprises shutting in production from each of the at least two production wells. This is provided at Box 1540 of FIG. 15A. Shutting in the production wells may mean closing subsea production valves, such as is shown with valves 316 in FIG. 5.

The method 1500 additionally includes determining a portion of the single production line that may enter a hydrate formation phase after a shut-in period. This is shown at Box 1545 of FIG. 15B. The shut-in period is at least 15 hours and, more preferably, at least 20 hours. The shut-in period may include a no-touch time and a light touch time before any hydrate inhibitor or other displacement fluid is injected.

The method 1500 further includes applying electrically generated heat along the selected portion of the single production line. This step is shown in Box 1550 of FIG. 15B. The selected portion is the determined portion of the single production line to be heated. The heat may be generated by applying current through resistive heating elements such as conductive coils. More preferably, the electrically generated heat is applied by flowing electrical current through the production flowline and riser itself as part of an electrical circuit. In either respect, the purpose for applying heat is to maintain production fluids within the production line at a temperature above a hydrate formation temperature after production has been shut in.

The method 1500 also comprises injecting a displacement fluid from the host production facility into a production manifold of the production cluster. This step is seen at Box 1555. The displacement fluid may be, for example, a dead crude or diesel. The displacement fluid moves the pig from the subsea storage location, thereby at least partially displacing production fluids from the production cluster. The pig is moved up to a location proximate a beginning of the heated portion of the single production line.

The method 1500 may optionally include activating a subsea pump. This is seen at Box 1560. In one aspect, a pump rate is applied that moves the pig at a velocity of 0.3 to 0.5 meters per second (0.98 to 1.64 feet/second). This may be done under shut-in conditions using a booster pump on the seabed placed along the service line.

Additionally, the method 1500 includes producing hydrocarbon fluids from the one or more production wells. This is indicated at Box 1565. In order to produce again, each of the production wells is put back into production. This may be in accordance with the step shown in FIG. 12 and described above. Hydrocarbon fluids are produced through the production manifold, through the production flowline, through the production riser, and to the host production facility.

A method of designing a subsea production system is also provided herein. FIG. 16 is a flowchart showing steps for performing the method 1600 of designing a subsea production system, in one embodiment. In the method 1600, the subsea production system has:

- a host production facility;
- a production cluster comprising two or more producers and a production manifold;
- a water injection cluster comprising one or more water injectors;
- a water injection line; and
- a single production line for directing fluids from the two or more producers to the host production facility.

In one embodiment, the method 1600 first includes determining a water depth for the placement of the production cluster. This is shown at Box 1605. The method 1600 also includes determining a temperature of the water at a location for the production cluster. This is seen at Box 1610. This refers to a seabed temperature.

Further, the method 1600 includes determining a length for a subsea production flowline and a production riser. This is indicated at Box 1615. The production flowline and the production riser together comprise the single production line. In one embodiment, the single production line has a length that is at least 10 km (6.2 miles).

The method 1600 also includes determining a location for the storage of a pig in the subsea production system. This is shown at Box 1620. The method 1600 also includes confirming that production fluids that will flow through the production cluster will comprise at least 50% vol. liquid phase fluids. This is seen at Box 1625.

In addition, the method 1600 comprises determining a portion of the single production line that may enter a hydrate formation phase after a shut-in period. This is indicated at Box 1630. The shut-in period is at least 15 hours and, more preferably, at least 30 hours. The shut-in period may include a no-touch time and a light touch time before any hydrate inhibitor or other displacement fluid is injected. As noted above, various factors may be considered when determining the portion of the single production line that may enter a hydrate formation phase. These include (i) temperature of produced fluids at the wellheads, (ii) production fluid composition; (iii) seabed incline, (iv) internal diameter of the displacement fluid service line, (v) temperature gradient within the water column, (vi) fluid pressure within the production line, or (vii) combinations thereof.

Still further, the method 1600 includes providing heating along the single production line. This is shown at Box 1635. In one aspect, heating elements are used for applying electrically resistive heat to the determined portion of the single production line after production has been shut in. Preferably, the one or more heating elements are located no closer than about 2 km (6,561 feet) from the production manifold, or even no closer than about 8 km (24,247 feet). In another aspect, heating is supplied by flowing electrical current through the production flowline and riser, forming an electrical circuit.

More specifically, current flows through an inner fluid-transporting pipe, through a conductive connector, and through a surrounding carrier pipe.

As can be seen, an improved method for inhibiting hydrates, and an improved subsea production system have been provided. The subsea production system utilizes a single production flowline. In one aspect, the subsea production system is intended to provide a single production flowline requiring a low chemical demand. Minimal use of methanol and chemicals for hydrate management is provided. The subsea production system is preferably used for single-field subsea tiebacks having a length that is greater than 10 km (6.2 miles), although precise tieback limits are case-specific. An improved method of managing hydrates in the subsea production system is also provided herein.

The following methods and systems are included herein:

1. A method of managing hydrates in a subsea production system, comprising:
   storing a pig in a subsea production system, the subsea production comprising:
   a host production facility,
   a production cluster comprising one or more producers,
   a water injection cluster comprising one or more water injectors,
   a water injection line, and
   a single production line for directing fluids from the production cluster to the host production facility;
   shutting in production from the one or more producers;
   applying electrically resistive heat along a selected portion of the single production line in order to maintain production fluids within the production line at a temperature above a hydrate formation temperature after production has been shut in; and
   injecting a displacement fluid into the subsea production system in order to move the pig within the subsea production cluster, thereby moving the pig and displacing production fluids from the production cluster up to a location proximate a beginning of the heated portion of the single production line.
2. The method of sub-paragraph 1, wherein:
   the single production line comprises a subsea production flowline and a production riser in fluid communication with the host production facility; and
   the production line is at least 10 km (6.2 miles) in length.
3. The method of sub-paragraph 2, wherein the production line is at least 30 km (18.6 miles) in length.
4. The method of sub-paragraph 2, wherein the displacement fluid is crude oil, diesel, or a combination thereof.
5. The method of sub-paragraph 4, wherein the displacement fluid comprises a hydrate inhibitor.
6. The method of sub-paragraph 2, wherein:
   the production cluster further comprises a production manifold, and jumpers for providing fluid communication between the production manifold and the one or more producers; and
   the method further comprises producing production fluids through the single production line and to the host production facility before shutting in production from the one or more producers, the production fluids comprising at least 50% vol. liquid phase fluids at the production manifold.
7. The method of sub-paragraph 6, wherein:
   the subsea production system further comprises a control umbilical having a hydrate inhibitor line and a displacement fluid service line; and
   injecting a displacement fluid comprises injecting the displacement fluid into the subsea production system through the displacement fluid service line.
8. The method of sub-paragraph 7, wherein:
   the displacement fluid comprises hydrate inhibitor; and
   injecting a displacement fluid into the subsea production system further comprises pumping the hydrate inhibitor from the hydrate inhibitor line into the production manifold in order to provide light touch operations before moving the pig through the production cluster.
9. The method of sub-paragraph 7, wherein:
   the water injection cluster comprises one or more water injectors, and a water injection manifold; and
   the water injection line comprises a water injection riser and a subsea flowline for receiving injection water from the host production facility.
10. The method of sub-paragraph 9, wherein:
   storing a pig in the subsea production system comprises injecting the pig into the water injection line, and advancing the pig into a subsea storage location in the subsea production system using injection water; and
   the method further comprises:
   storing the pig in the subsea storage location for a period of time;
   launching the pig from the subsea storage location ahead of the displacement fluid; and
   discontinuing injecting once the pig has reached a location along the heated portion of the single production line.
13. The method of sub-paragraph 10, wherein the method further comprises:
   launching a new pig from the host production facility, through the water injection riser, through the water injection flowline, and to the subsea storage location;
   storing the new pig in the subsea storage location; and
   putting the producers back into production.
14. The method of sub-paragraph 6, wherein storing a pig in the subsea production system comprises placing the pig into a subsea pig launcher, and the method further comprises:
   storing the pig in the subsea pig launcher for a period of time;
   launching the pig from the subsea pig launcher after the period of time; and
   discontinuing injecting once the pig has reached a location along the heated portion of the single production line.
15. The method of sub-paragraph 6, further comprising:
   determining a portion of the single production line that may enter a hydrate formation phase after a shut-in period of at least 15 hours; and
   identifying at least said determined portion as the selected portion of the single production line to be heated.
16. A method of managing hydrates in a subsea production system, comprising:
   storing a pig in a storage location within a subsea production system, the subsea production system having:
   a host production facility,
   a production cluster comprising one or more producers,
   a water injection cluster comprising one or more water injectors,
   a crossover manifold placing the production cluster and the water injection cluster in selective fluid communication,
   a water injection line, and
   a single production line comprising a subsea flow line and a production riser extending at least about 30 km (18.6 miles) for directing fluids from the one or more producers to the host production facility;

producing production fluids through the single production line and to the host production facility, the production fluids comprising at least 50% vol. liquid phase fluids at the production manifold;

shutting in production from the one or more producers;

applying electrically resistive heat along a selected portion of the single production line in order to maintain production fluids within the production line at a temperature above a hydrate formation temperature after production has been shut in;

injecting a displacement fluid from the host production facility into a production manifold of the production cluster to; and further injecting the displacement fluid in order to move the pig from the subsea storage location, thereby displacing production fluids from the production cluster and moving the pig up to a location along the heated portion of the single production line.

17. The method of sub-paragraph 16, wherein:

the subsea storage location is a water injection manifold in the water injection cluster; and the displacement fluid is a dead displacement fluid.

18. The method of sub-paragraph 16, further comprising:

determining a portion of the single production line that may enter a hydrate formation phase after a shut-in period of at least 15 hours; and identifying said determined portion as the selected portion of the single production line to be heated.

19. A method of constructing a subsea production system at a location in a marine body, the marine body having a water surface and a seabed depth of at least 500 meters (1,640.4 feet) below the water surface, and the location having a seabed temperature below 5° C. (41° F.), the method comprising:

providing a host production facility;

forming a production cluster comprising at least one production well, each production well having a well head on the seabed;

forming a water injection cluster comprising at least one water injection well;

providing a crossover manifold placing the production cluster and the water injection cluster in selective fluid communication;

providing a single production line comprising a subsea flow line and a production riser, the single production line extending at least about 30 km (18.6 miles) from the production cluster to the host production facility;

providing a water injection line from the host product facility to the water injection cluster;

storing a pig in a subsea storage location;

shutting in production from each of the at least two production wells;

applying electrically resistive heat along a selected portion of the single production line in order to maintain production fluids within the production line at a temperature above a hydrate formation temperature after production has been shut in; and injecting a displacement fluid from the host production facility into a production manifold of the production cluster to move the pig from the subsea storage location, thereby at least partially displacing production fluids from the production cluster and moving the pig up to a location proximate a beginning of the heated portion of the single production line.

20. The method of sub-paragraph 19, further comprising:

determining a portion of the single production line that may enter a hydrate formation phase after a shut-in period of at least 15 hours; and identifying said determined portion as the selected portion of the single production line to be heated.

21. A method of designing a subsea production system, the subsea production system having a host production facility, a production cluster comprising two or more producers and a production manifold, a water injection cluster comprising one or more water injectors, a water injection line, and a single production line for directing fluids from the two or more producers to the host production facility, the method comprising:

determining a water depth for the placement of the production cluster;

determining a temperature of the water at a location for the production cluster;

determining a length for a subsea production flowline and a production riser, the production flowline and the production riser together comprising the single production line, the single production line having a length that is at least 10 km (6.2 miles);

determining a location for the storage of a pig in the subsea production system;

confirming that production fluids that will flow through the production cluster will comprise at least 50% vol. liquid phase fluids;

determining a portion of the single production line that may enter a hydrate formation phase after a shut-in period of at least 15 hours; and providing one or more heating elements along the single production line for applying electrically resistive heat to the determined portion of the single production line after production has been shut in.

22. The method of sub-paragraph 21, wherein determining a portion of the single production line that may enter a hydrate formation phase comprises a consideration of (i) temperature of produced fluids at wellheads, (ii) production fluid composition; (iii) fluid pressure within the production flowline. (iv) seabed incline, (v) internal diameter of a displacement fluid service line, (vi) temperature gradient within the water column, or (vii) combinations thereof.

While it will be apparent that the inventions herein described are well calculated to achieve the benefits and advantages set forth above, it will be appreciated that the invention is susceptible to modification, variation and change without departing from the spirit thereof.

What is claimed is:

1. A method of managing hydrates in a subsea production system, comprising:

storing a pig in a subsea production system, the subsea production system comprising:

at least one host production facility, a production cluster comprising one or more producers, a water injection cluster comprising one or more water injectors, a water injection line, and a single production line for directing production fluids from the production cluster to the at least one host production facility;

shutting in production from the one or more producers;

applying electrically resistive heat along a selected portion of the single production line in order to maintain production fluids within the single production line at a temperature above a hydrate formation temperature after production has been shut in; and injecting a displacement fluid into the subsea production system in order to move the pig within the subsea production cluster, thereby moving the pig and displacing production fluids from the production cluster up to a location proximate a beginning of the heated portion of the single production line to manage hydrates.

2. The method of claim 1, wherein:

the single production line comprises a subsea production flowline and a production riser in fluid communication with the at least one host production facility; and the single production line is at least 10 km (6.2 miles) in length.

3. The method of claim 2, wherein the single production line is at least 30 km (18.6 miles) in length.

4. The method of claim 2, wherein the displacement fluid is crude oil, diesel, or a combination thereof.

5. The method of claim 4, wherein the displacement fluid comprises a hydrate inhibitor.

6. The method of claim 2, wherein:

the production cluster further comprises a production manifold, and jumpers for providing fluid communication between the production manifold and the one or more producers; and the method further comprises producing production fluids through the single production line and to the at least one host production facility before shutting in production from the one or more producers, the production fluids comprising at least 50% vol. liquid phase fluids at the production manifold.

7. The method of claim 6, wherein:

the subsea production system further comprises a control umbilical having a hydrate inhibitor line and a displacement fluid service line; and injecting a displacement fluid comprises injecting the displacement fluid into the subsea production system through the displacement fluid service line.

8. The method of claim 7, wherein the displacement fluid service line is internal to the control umbilical and has an inner diameter of no greater than about 7.62 cm (3 inches).

9. The method of claim 7, wherein the displacement fluid service line is external to the control umbilical and has an inner diameter of about 10.16 cm (4 inches) to 15.24 cm (6 inches).

10. The method of claim 7, wherein:

the displacement fluid comprises hydrate inhibitor; and injecting a displacement fluid into the subsea production system further comprises pumping the hydrate inhibitor from the hydrate inhibitor line into the production manifold in order to provide light touch operations before moving the pig through the production cluster.

11. The method of claim 7, wherein:

the water injection cluster comprises one or more water injectors, and a water injection manifold; and the water injection line comprises a water injection riser and a subsea flowline for receiving injection water from the at least one host production facility.

12. The method of claim 11, wherein:

storing a pig in the subsea production system comprises injecting the pig into the water injection line, and advancing the pig into a subsea storage location in the subsea production system using injection water; and the method further comprises:

storing the pig in the subsea storage location for a period of time;

launching the pig from the subsea storage location ahead of the displacement fluid; and discontinuing injecting once the pig has reached a location along the heated portion of the single production line.

13. The method of claim 12, wherein the production riser comprises an insulated pipe-in-pipe flowline.

14. The method of claim 13, wherein the displacement fluid service line is sized to move the pig through the subsea production flowline at a minimum velocity of 0.3 meters/second (1 ft/sec).

15. The method of claim 14, wherein:

the subsea production system further comprises a subsea pump placed along the displacement fluid service line; and the method further comprises activating the subsea pump in order to assist in pumping the displacement fluid and moving the pig.

16. The method of claim 12, further comprising:

isolating the subsea storage location after launching the pig.

17. The method of claim 12, wherein:

the subsea production system further comprises a crossover manifold;

a central pipeline resides in the crossover manifold and provides fluid communication between the water injection cluster and the production cluster; and launching the pig comprises advancing the pig from the subsea storage location, through the central pipeline, and to the production manifold.

18. The method of claim 12, wherein the method further comprises:

launching a new pig from the at least one host production facility, through the water injection riser, through the water injection line, and to the subsea storage location;

storing the new pig in the subsea storage location; and putting the one or more producers back into production.

19. The method of claim 16, further comprising:

putting the one or more producers back into production after applying electrically resistive heat during a shut down period; and producing production fluids which includes directing production fluids from the one or more producers, through the production manifold, through the subsea production flowline, through the production riser, and to the at least one host production facility.

20. The method of claim 19, further comprising:

injecting injection water through the one or more water injectors.

21. The method of claim 20, wherein water continues to be injected through the one or more water injectors while the pig is being moved to the subsea production cluster.

22. The method of claim 2, further comprising:

depressuring the single production line after shutting in production from the one or more producers.

23. The method of claim 6, wherein storing a pig in the subsea production system comprises placing the pig into a subsea pig launcher, and the method further comprises:

storing the pig in the subsea pig launcher for a period of time;

launching the pig from the subsea pig launcher after the period of time; and discontinuing injecting once the pig has reached a location along the heated portion of the single production line.

24. The method of claim 6, further comprising:

determining a portion of the single production line that may enter a hydrate formation phase after a shut-in period of at least 15 hours; and identifying at least said determined portion as the selected portion of the single production line to be heated.

25. The method of claim 24, wherein the shut-in period is at least 30 hours.

26. A method of managing hydrates in a subsea production system, the method comprising:

storing a pig in a storage location within a subsea production system, the subsea production system having:

at least one host production facility, a production cluster comprising one or more producers, a water injection cluster comprising one or more water injectors, a crossover manifold placing the production cluster and the water injection cluster in selective fluid communication, a water injection line, and a single production line comprising a subsea flow line and a production riser extending at least about 30 km (18.6 miles) for directing fluids from the one or more producers to the at least one host production facility;

producing production fluids which includes directing production fluids from the one or more producers through the single production line and to the at least one host production facility, the production fluids comprising at least 50% vol. liquid phase fluids at a production manifold of the production cluster;

shutting in production from the one or more producers;

applying electrically resistive heat along a selected portion of the single production line in order to maintain production fluids within the single production line at a temperature above a hydrate formation temperature after production has been shut in;

injecting a displacement fluid from the at least one host production facility into the production manifold of the production cluster; and further injecting the displacement fluid in order to move the pig from the subsea storage location, thereby displacing production fluids from the production cluster and moving the pig up to a location along the heated portion of the single production line to manage hydrates.

27. The method of claim 26, wherein:

the subsea storage location is a water injection manifold in the water injection cluster; and the displacement fluid is a dead displacement fluid.

28. The method of claim 26, further comprising:

determining a portion of the single production line that may enter a hydrate formation phase after a shut-in period of at least 15 hours; and identifying said determined portion as the selected portion of the single production line to be heated.

29. The method of claim 28, wherein the shut-in period is at least 30 hours.

30. A method of constructing a subsea production system at a location in a marine body, the marine body having a water surface and a seabed depth of at least 500 meters (1,640.4 feet) below the water surface, and the location having a seabed temperature below 5° C. (41° F.), the method comprising:

providing at least one host production facility;

forming a production cluster comprising at least one production well, each production well having a well head on the seabed;

forming a water injection cluster comprising at least one water injection well;

providing a crossover manifold placing the production cluster and the water injection cluster in selective fluid communication;

providing a single production line comprising a subsea flow line and a production riser, the single production line extending at least about 30 km (18.6 miles) from the production cluster to the at least one host production facility;

providing a water injection line from the at least one host production facility to the water injection cluster;

storing a pig in a subsea storage location;

shutting in production from each production well;

applying electrically resistive heat along a selected portion of the single production line in order to maintain production fluids within the single production line at a temperature above a hydrate formation temperature after production has been shut in; and injecting a displacement fluid from the at least one host production facility into a production manifold of the production cluster to move the pig from the subsea storage location, thereby at least partially displacing production fluids from the production cluster and moving the pig up to a location proximate a beginning of the heated portion of the single production line to manage hydrates.

31. The method of claim 30, further comprising:

activating a subsea pump placed along a displacement fluid service line in order to assist in pumping the displacement fluid and move the pig.

32. The method of claim 30, wherein:

the subsea storage location is a water injection manifold in the water injection cluster; and the displacement fluid is a dead displacement fluid.

33. The method of claim 30, further comprising:

determining a portion of the single production line that may enter a hydrate formation phase after a shut-in period of at least 15 hours; and identifying said determined portion as the selected portion of the single production line to be heated.

34. The method of claim 33, wherein the shut-in period is at least 30 hours.

35. The method of claim 33, further comprising:

putting each production well back into production; and producing production fluids which includes directing production fluids from each production well, through the production manifold, through the single production line to the at least one host production facility.

36. The method of claim 35, further comprising:

activating a subsea pump placed proximate a bottom of the production riser to assist in moving produced production fluids to the at least one host production facility.

37. A method of designing a subsea production system, the subsea production system having at least one host production facility, a production cluster comprising one or more producers and a production manifold, a water injection cluster comprising one or more water injectors, a water injection line, and a single production line for directing production fluids from the one or more producers to the at least one host production facility, the method comprising:

determining a water depth for the placement of the production cluster;

determining a temperature of the water at a location for the production cluster;

determining a length for a subsea production flowline and a production riser, the production flowline and the production riser together comprising the single production line, the single production line having a length that is at least 10 km (6.2 miles);

determining a location for the storage of a pig in the subsea production system, the subsea production system configured such that a displacement fluid will move the pig from the determined storage location a partial distance along the single production line to manage hydrates;

confirming that production fluids that will flow through the production cluster will comprise at least 50% vol. liquid phase fluids;

determining a portion of the single production line that may enter a hydrate formation phase after a shut-in period of at least 15 hours; and providing one or more heating elements along the single production line for applying electrically resistive heat to the determined portion of the single production line after production has been shut in.

38. The method of claim 37, wherein the single production line is at least 30 km (18.6 miles) in length.

39. The method of claim 37, wherein the shut-in period is at least 30 hours.

40. The method of claim 37, wherein determining the portion of the single production line that may enter a hydrate formation phase comprises a consideration of (i) temperature of produced fluids at wellheads, (ii) production fluid composition; (iii) fluid pressure within the single production line, (iv) seabed incline, (v) internal diameter of a displacement fluid service line, (vi) temperature gradient within a water column between the at least one host production facility and a seabed, or (vii) combinations thereof.

41. A system for managing hydrates in a subsea production system, the subsea production system comprising:

a single production line;

a production cluster comprising one or more producers, with each of the one or more producers being fluidly connected to the single production line for directing fluids from the production cluster to at least one host production facility;

a water injection line;

a water injection cluster comprising one or more water injectors, with each of the one or more water injectors being fluid connected to the water injection line;

a subsea storage location configured to receive a pig, the subsea storage location being fluidly connected to at least the water injection line, the single production line, and a chemical injection service line;

a crossover manifold operatively connected to the production cluster, the water injection cluster, and the chemical injection service line configured to inject a hydrate inhibitor into the crossover manifold to move the pig through the production cluster and into the single production line; and an electrical source configured to deliver an electrical current to a portion of the single production line, the portion representing a portion of the single production line having production fluids that may enter a hydrate formation phase after a shut-in period of at least 15 hours.

42. The system of claim 41, further comprising:

the at least one host production facility fluidly connected to (i) the water injection cluster by the water injection line, and (ii) the production cluster by the single production line.

43. The system of claim 42, further comprising a control umbilical, the control umbilical having:

a displacement fluid injection service line configured to inject displacement fluid into the crossover manifold; and the chemical injection service line.

44. The system of claim 42, wherein:

the single production line comprises a subsea production flowline and a production riser in fluid communication with the at least one host production facility; and the single production line is at least 10 km (6.2 miles) in length.

* * * * *